US011043181B2

(12) United States Patent
Yamada et al.

(10) Patent No.: US 11,043,181 B2
(45) Date of Patent: Jun. 22, 2021

(54) DISPLAY UNIT

(71) Applicant: JOLED INC., Tokyo (JP)

(72) Inventors: Jiro Yamada, Tokyo (JP); Tetsuro Yamamoto, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 16/268,421

(22) Filed: Feb. 5, 2019

(65) Prior Publication Data

US 2019/0355323 A1 Nov. 21, 2019

(30) Foreign Application Priority Data

May 16, 2018 (JP) ..... JP2018-094851

(51) Int. Cl.
*G09G 3/38* (2006.01)
*G09G 3/34* (2006.01)

(52) U.S. Cl.
CPC ..... *G09G 3/38* (2013.01); *G09G 3/344* (2013.01); *G09G 3/348* (2013.01); *G09G 2320/0242* (2013.01)

(58) Field of Classification Search
CPC ..... G09G 3/38; G09G 3/344; G09G 3/3446; G09G 3/3453; G09G 3/348; G09G 3/32; G09G 3/36; G09G 3/30
See application file for complete search history.

(56) References Cited

U.S. PATENT DOCUMENTS 9,368,062 B2 * 6/2016 Zhang ..... G02F 1/167
2003/0103021 A1 * 6/2003 Young ..... G09G 3/3659 345/76
2007/0268245 A1 * 11/2007 Sugita ..... G09G 3/3446 345/107
2012/0032992 A1 * 2/2012 Lim ..... G09G 3/3446 345/690
2012/0327498 A1 12/2012 Arai et al.
(Continued)

FOREIGN PATENT DOCUMENTS

JP 2009251540 A 10/2009
JP 2011221121 A 11/2011
(Continued)

OTHER PUBLICATIONS

Ryou Onodera et al, "Smart Windows, Switchable between Transparent, Mirror and Black States, Fabricated Using Rough and Smooth Indium Tin Oxide Films Deposited by Spray Chemical Vapor Deposition", Applied physics express, Feb. 7, 2013, vol. 6, Issue 2, 026503-1 to 026503-3 pages, The Japan Society of Applied Physics through the Institute of Pure and Applied Physics, Japan, 3pp.

*Primary Examiner* — Alexander Eisen
*Assistant Examiner* — Cory A Almeida
(74) *Attorney, Agent, or Firm* — Hauptman Ham, LLP

(57) ABSTRACT

A display unit includes a display panel that includes a plurality of pixels arranged in a matrix. Each of the pixels includes one of an optical modulator and a self-luminescent element, and one of an electrochromic element, an electrophoretic element, and an electrowetting element. Each of the pixels further includes a pixel circuit that is configured to selectively drive the one of the optical modulator and the self-luminescent element, and selectively drive the one of the electrochromic element, the electrophoretic element, and the electrowetting element.

11 Claims, 20 Drawing Sheets

(56) References Cited

U.S. PATENT DOCUMENTS

| | | | | |
|---|---|---|---|---|
| 2013/0194167 | A1 | 8/2013 | Yun et al. | |
| 2015/0228217 | A1* | 8/2015 | Perdices-Gonzalez | G09G 3/348 345/5 |
| 2018/0059499 | A1 | 3/2018 | Klement et al. | |
| 2018/0083075 | A1 | 3/2018 | Jung et al. | |

FOREIGN PATENT DOCUMENTS

| | | | |
|---|---|---|---|
| JP | 20133480 | A | 1/2013 |
| JP | 2013-156635 | A | 8/2013 |
| JP | 2013167659 | A | 8/2013 |
| JP | 2014-72126 | A | 4/2014 |
| JP | 201635521 | A | 3/2016 |
| KR | 10-2018-0022592 | A | 3/2018 |
| KR | 10-2018-0032751 | A | 4/2018 |

* cited by examiner

DISPLAY UNIT

CROSS REFERENCE TO RELATED APPLICATIONS

This application claims the benefit of Japanese Priority Patent Application No. 2018-094851 filed on May 16, 2018, the entire contents of which are incorporated herein by reference.

BACKGROUND

The disclosure relates to a display unit.

A variety of display units have been proposed which include organic electroluminescent elements. Reference is made to Japanese Unexamined Patent Application Publication Nos. 2013-156635 and 2014-072126, for example.

SUMMARY

It is desired that a display unit display an image based on an image signal in a display region while performing a process of enhancing a display quality in the display region, to achieve novel image-display representation.

It is desirable to provide a display unit that makes it possible to achieve image displaying based on an image signal in a display region while enhancing a display quality in the display region to achieve novel image-display representation.

A display unit according to one embodiment of the disclosure includes a display panel that includes a plurality of pixels arranged in a matrix. Each of the pixels includes: one of an optical modulator and a self-luminescent element; one of an electrochromic element, an electrophoretic element, and an electrowetting element; and a pixel circuit configured to selectively drive the one of the optical modulator and the self-luminescent element, and the one of the electrochromic element, the electrophoretic element, and the electrowetting element.

BRIEF DESCRIPTION OF THE DRAWINGS

The accompanying drawings are included to provide a further understanding of the technology and are incorporated in and constitute a part of this specification. The drawings illustrate example embodiments and, together with the specification, serve to explain the principles of the technology.

DETAILED DESCRIPTION

Figure 1:
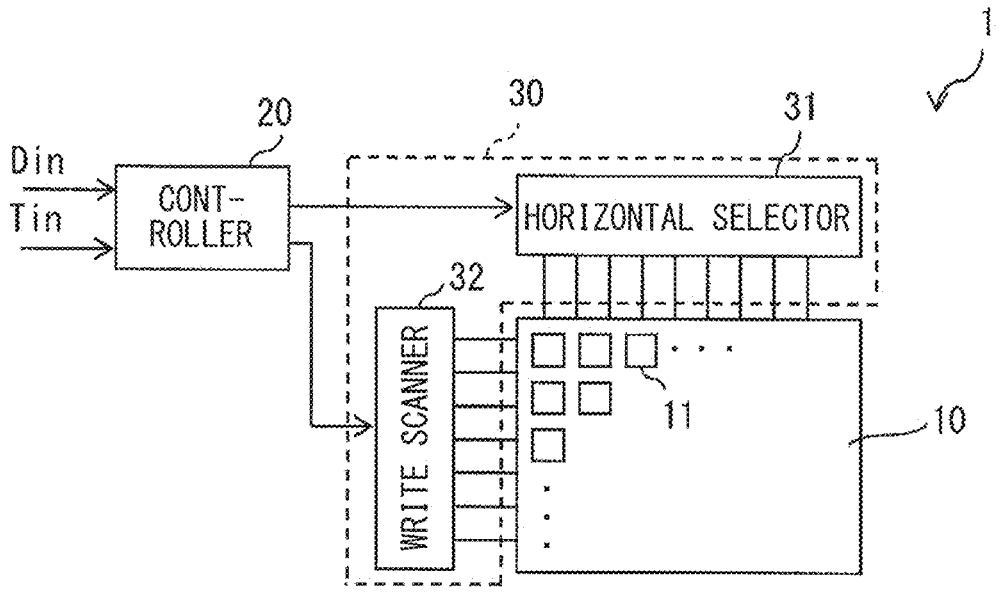
FIG. 1 is a schematic diagram of an example configuration of a display unit according to one embodiment of the disclosure.

In the following, some example embodiments of the disclosure are described in detail, in the following order, with reference to the accompanying drawings. Note that the following description is directed to illustrative examples of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiments which are not recited in a most-generic independent claim of the disclosure are optional and may be provided on an as-needed basis. The drawings are schematic and are not intended to be drawn to scale. Note that the like elements are denoted with the same reference numerals, and any redundant description thereof will not be described in detail.

1. Embodiment

Example Configuration

Figure 2:
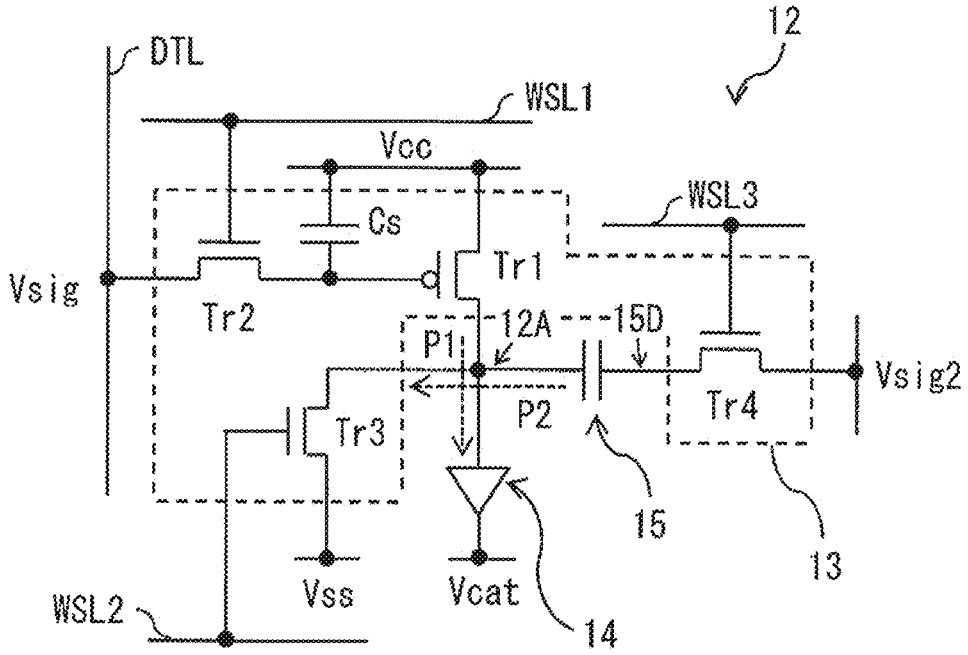
FIG. 2 is an example circuit diagram of a subpixel included in each pixel illustrated in FIG. 1.

FIG. 1 is a schematic diagram of an example configuration of a display unit 1 according to an example embodiment of the disclosure. FIG. 2 is an example circuit diagram of a subpixel 12 included in each pixel of the display unit 1. The display unit 1 may include, for example, an organic electroluminescent (EL) panel 10, a controller 20, and a driver 30. The driver 30 may be mounted on an outer edge portion of the organic EL panel 10, for example. The organic EL panel 10 includes a plurality of pixels 11 arranged in a matrix. The controller 20 and the driver 30 may drive the organic EL panel 10 (i.e., the pixels 11) on the basis of an external image signal Din and an external synchronizing signal Tin. The organic EL panel 10 may correspond to a specific but non-limiting example of "display panel" according to one embodiment of the disclosure.

[Organic EL Panel 10]

In response to the active-matrix driving of the pixels 11 performed by the controller 20 and the driver 30, the organic EL panel 10 may display an image based on the external image signal Din and the external synchronizing signal Tin. Additionally, the organic EL panel 10 may perform an enhancement of the image that is displayed on the basis of the image signal Din and the synchronizing signal Tin, in response to the active-matrix driving. The enhancement of the image is described in detail below. The organic EL panel 10 may include multiple scanning lines WSL1, WSL2, and WSL3 that extend in a row direction, multiple signal lines DTL extending in a column direction, and the multiple pixels 11 arranged in matrix.

The scanning lines WSL1 may be used to select the pixels 11. For example, a selection pulse may be supplied through the scanning lines WSL1 to the pixels 11 to select the pixels 11 on a predetermined unit basis. The pixels 11 may be selected on a pixel-row basis, for example. The scanning lines WSL2 and WSL3 may be used to select electrochromic (EC) elements 15 (described below) in each of the pixels 11. In other words, the scanning lines WSL2 and WSL3 may be used to apply a voltage to the EC elements 15. The signal lines DTL may be used to supply a signal voltage Vsig based on the image signal Din to the pixels 11. For example, a data pulse that includes a signal voltage Vsig may be supplied through the signal lines DTL to the pixels 11.

The pixels 11 may each include, for example, a subpixel 12 emitting red light, a subpixel 12 emitting green light, a subpixel emitting blue light, and a subpixel emitting white light. In other words, a predetermined number of the subpixels 12 may be grouped into a color pixel (i.e., the pixel 11). Optionally, the pixel 11 may further include a subpixel 12 emitting light of another color, such as yellow. Alternatively, the pixel 11 may include no subpixel 12 emitting white light. Still alternatively, the pixel 11 may include a subpixel 12 emitting yellow light in place of the subpixel 12 emitting white light.

Each of the signal lines DTL may be coupled to an output terminal of a horizontal selector 31 described below. Each of the signal lines DTL may be allocated to its corresponding pixel column, for example. The scanning lines WSL1, WSL2, and WSL3 may be each coupled to an output terminal of a write scanner 32 described below. Each of the scanning lines WSL1 may be allocated to its corresponding pixel row, for example. Additionally, each of the scanning lines WSL2 may be allocated to its corresponding pixel row, for example. Furthermore, each of the scanning lines WSL3 may be allocated to its corresponding pixel row, for example.

Each of the subpixels 12 includes a pixel circuit 13, an organic EL element 14, and an electrochromic (EC) element 15. The configurations of the organic EL element 14 and the EC element 15 are described in detail below. The organic EL element 14 may correspond to a specific but non-limiting example of "self-luminescent element" according to one embodiment of the disclosure. The EC element 15 may correspond to a specific but non-limiting example of "electrochromic element" according to one embodiment of the disclosure.

The pixel circuit 13 may control light emission and light extinction of the organic EL element 14, and a change in state of the EC element 15. The pixel circuit 13 may hold a voltage written into the subpixel 12 through write scanning described below. The pixel circuit 13 may include, for example, a driving transistor Tr1, a writing transistor Tr2, switching transistors Tr3 and Tr4, and a storage capacitor Cs.

The writing transistor Tr2 may control application of the signal voltage Vsig to a gate of the driving transistor Tr1. The signal voltage Vsig may correspond to the image signal Din. For example, the writing transistor Tr2 may sample a voltage of the signal line DTL and write the sampled voltage into the gate of the driving transistor Tr1. The driving transistor Tr1 may be coupled in series to the organic EL element 14. The driving transistor Tr1 may drive the organic EL element 14. The driving transistor Tr1 may control an electric current flowing in the organic EL element 14 on the basis of the magnitude of the voltage sampled at the writing transistor Tr2. The storage capacitor Cs may hold a predetermined voltage between the gate and source of the driving transistor Tr1. The storage capacitor Cs may hold a gate-source voltage Vgs of the driving transistor Tr1 at a constant level for a predetermined period of time.

The switching transistors Tr3 and Tr4 may control application of a signal voltage Vsig2 to the EC element 15. The signal voltage Vsig2 may be irrelevant to the image signal Din. The switching transistors Tr3 and Tr4 may be coupled in series to the EC element 15. The EC element 15 may be coupled in parallel to the organic EL element 14. An electric current path P2 of an electric current flowing through the switching transistor Tr4, the EC element 15, and the switching transistor Tr3 may intersect with an electric current path P1 of an electric current flowing through the driving transistor Tr1 and the organic EL element 14, at a node between the EC element 15 and the organic EL element 14. This allows the pixel circuit 13 to selectively drive the organic EL element 14 and the EC element 15. Note that the pixel circuit 13 may have a circuit configuration that includes the 4Tr1C circuit described above and additional capacitors and transistors. Alternatively, the pixel circuit 13 may have a different circuit configuration from the 4Tr1C circuit described above.

Each of the signal lines DTL may be coupled to the output terminal of the horizontal selector 31 described below and a source or drain of the writing transistor Tr2. Each of the scanning lines WSL1 may be coupled to the output terminal of the write scanner 32 and a gate of the writing transistor Tr2. Each of the scanning lines WSL2 may be coupled to the output terminal of the write scanner 32 described below and the gate of the switching transistor Tr3. Each of the scanning lines WSL3 may be coupled to the output terminal of the write scanner 32 described below and the gate of the switching transistor Tr3.

The gate of the writing transistor Tr2 may be coupled to the scanning line WSL1. One of the source and drain of the writing transistor Tr2 may be coupled to the signal lines DTL. The other of the source and drain of the writing transistor Tr2 that is uncoupled to the signal lines DTL may be coupled to the gate of the driving transistor Tr1. One of source and drain of the driving transistor Tr1 may be coupled to a wiring line at a voltage Vcc. The other of the source and drain of the driving transistor Tr1 that is uncoupled to the wiring line at the voltage Vcc may be coupled to an anode (i.e., an electrode 12A described below) of the organic EL element 14. One terminal of the storage capacitor Cs may be coupled to the gate of the driving transistor Tr1. In an example where the driving transistor Tr1 is a p-channel transistor, the other terminal of the storage capacitor Cs may be coupled to the wiring line at the voltage Vcc.

The gate of the switching transistor Tr3 may be coupled to the scanning line WSL2. One of source and drain of the switching transistor Tr3 may be coupled to the anode of the organic EL element 14. The other of the source and drain of the switching transistor Tr3 that is uncoupled to the anode of the organic EL element 14 may be coupled to the wiring line at the voltage Vss. A gate of the switching transistor Tr4 may be coupled to the scanning line WSL3. One of the source and drain of the switching transistor Tr4 may be coupled to the EC element 15. The other of the source and drain of the switching transistor Tr4 that is uncoupled to the EC element 15 may be coupled to the wiring line at the signal voltage Vsig 2. The EC element 15 may be coupled to the anode of the organic EL element 14 and the source or drain of the switching transistor Tr4.

[Driver 30]

The driver 30 may include, for example, the horizontal selector 31 and the write scanner 32. The horizontal selector 31 may apply the analog signal voltage Vsig received from the controller 20 to each of the signal lines DTL in response to (in synchronization with) a control signal. The write scanner 32 may scan the subpixels 12 on a predetermined unit basis.

[Controller 20]

The controller 20 will now be described. The controller 20 may perform a predetermined correction on an external digital image signal Din, and generate a signal voltage Vsig on the basis of the corrected image signal, for example. The controller 20 may output the generated signal voltage Vsig to the horizontal selector 31, and output a control signal to each circuit in the driver 30 in response to (in synchronization with) an external synchronizing signal Tin.

Figure 3:
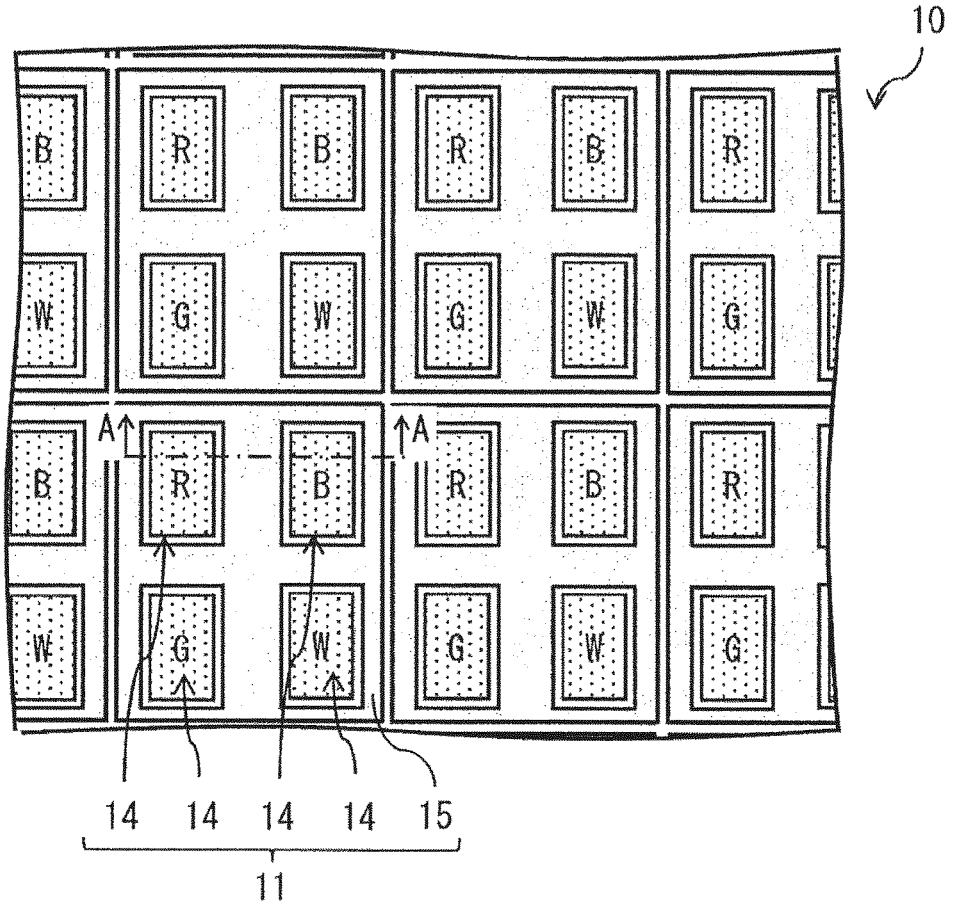
FIG. 3 is an example schematic view of an organic EL panel illustrated in FIG. 1.
Figure 4:
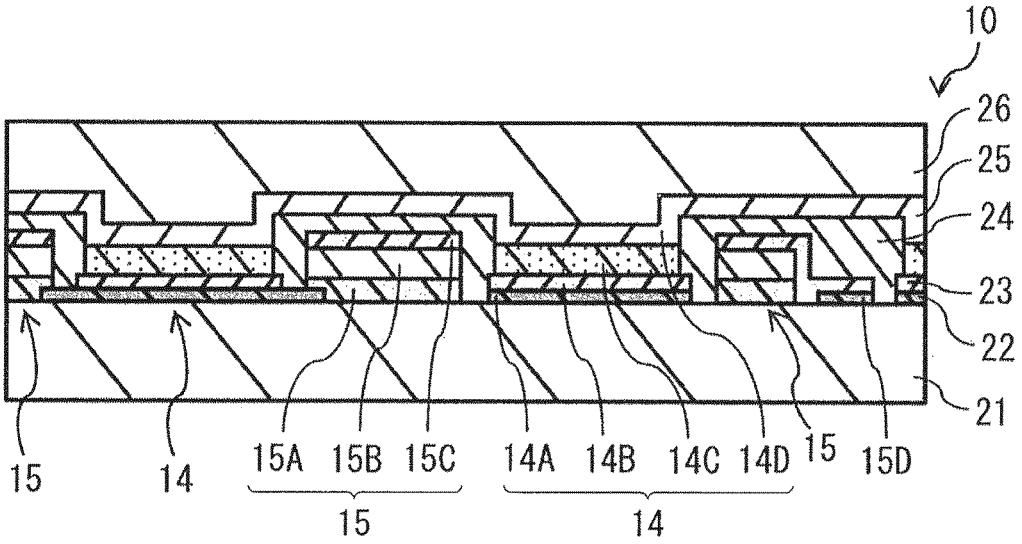
FIG. 4 is an example cross-sectional view of the organic EL panel taken along the line A-A in FIG. 3.

The organic EL element 14 and the EC element 15 will now be described with reference to FIGS. 3 and 4. FIG. 3 illustrates an example schematic configuration of the organic EL panel 10. FIG. 4 illustrates an example cross-sectional configuration of the organic EL panel 10 taken along the line A-A of FIG. 3 (i.e., along a row direction of the pixels 11).

In FIG. 3, a region patterned with dots may be provided with a light-emitting layer described below. The subpixel 12 emitting red light may be provided in a region R, the subpixel 12 emitting green light in a region G, the subpixel 12 emitting blue light in a region B, the subpixel 12 emitting white light in a region W. In FIG. 3, each of the pixels 11 may include four subpixels 12.

The organic EL panel 10 may include the pixels 11 arranged in a matrix. As described above, each of the pixels 11 may include, for example, the subpixel 12 emitting red light, the subpixel 12 emitting green light, the subpixel 12 emitting blue light, and the subpixel 12 emitting white light. The organic EL panel 10 may also include a plurality of non-luminescent pixels each including a light transmissive region 24B that transmits visual light.

The subpixel 12 emitting red light may include the organic EL element 14 emitting red light. The subpixel 12 emitting green light may include the organic EL element 14 emitting green light. The subpixel 12 emitting blue light may include the organic EL element 14 emitting blue light. The subpixel 12 emitting white light may include the organic EL element 14 emitting white light.

The organic EL panel 10 may include a substrate 21. The substrate 21 may include, for example, a base that supports the organic EL elements 14 and the EC elements 15, and a wiring layer provided on the base. The base of the substrate 21 may be, for example, a substrate having transmittance for visible light. The base of the substrate 21 may include, for example, non-alkali glass, soda glass, nonfluorescent glass, phosphate glass, borate glass, or quartz. Alternatively, the base of the substrate 21 may include, for example, acrylic resin, styrene resin, polycarbonate resin, epoxy resin, polyethylene, polyester, silicone resin, or alumina. Still alternatively, the base of the substrate 21 may be a substrate having no transmittance for visible light. The wiring layer of the substrate 21 may include, for example, the pixel circuits 13 of the respective pixels 11.

The organic EL panel 10 may include, on the substrate 21, the organic EL elements 14 each included in the subpixel 12, and the EC elements 15 each included in the subpixel 12, for example. The organic EL panel 10 may also include a sealing layer 26 that covers the organic EL elements 14 and the EC elements 15. The sealing layer 26 may include, for example, a light-transmissive resin. In an alternative example illustrate in FIG. 3, for example, the EC element 15 may be shared between the subpixels 12 in each of the pixels 11. In a still alternative example, the EC element 15 may be shared between the subpixels 12 in the plurality of pixels 11.

The organic EL element 14 may be a display element that performs light emission and light extinction in response to application of the signal voltage Vsig based on the image signal Din. The organic EL element 14 may include, for example, an electrode 14A, an indium tin oxide (ITO) layer 14B, an EL layer 14C, and an ITO layer 14D, in this order, on the substrate 21. The electrode 14A may serve as an anode, and the ITO layer 14D may serve as a cathode. In place of the ITO layer 14B, a layer that includes a transparent electrically-conductive material, such as indium zinc oxide (IZO), may be provided. In place of the ITO layer 14D, a layer that include a transparent electrically-conductive material, such as IZO, may be provided. The EL layer 14C may include, for example, a hole injection layer, a hole transport layer, a light-emitting layer, an electron transport layer, and an electron injection layer that are stacked in this order from the substrate 21.

In this example embodiment, the hole injection layer may enhance efficiency in injecting holes. The hole transport layer may transfer, to the light-emitting layer, holes injected from the electrode 14A serving as the anode. The light-emitting layer may emit light of a predetermined color through recombination of an electron and a hole. The electron transport layer may transfer, to the light-emitting layer, electrons injected from the ITO layer 14D serving as the cathode. The electron injection layer may enhance efficiency in injecting electrons.

The electrode 14A may be provided on the substrate 21, for example. The electrode 14A may be a reflective electrode that includes a material having reflectivity, such as aluminum (Al), silver (Ag), an aluminum alloy or a silver alloy. In an example where the electrode 14A has optical reflectivity and the ITO layer 14D has optical transparency, the organic EL element 14 may have a top-emission structure that emits light through the ITO layer 14D. In an alternative example, the ITO layer 14D may be a portion of an ITO layer 25 extending over the entire display region of the organic EL panel 10. In this example, the ITO layer 25 may be shared between the organic EL elements 14.

The EC elements 15 may be enhancement elements reversibly change their color in response to application of a voltage, and thereby perform an enhancement of an image on the organic EL panel 10 (i.e., an image generated through light-emission of the organic EL elements 14). The signal voltage Vsig2 irrelevant to the image signal Din may be applied to the EC elements 15. The term "enhancement" as used herein refers to color display, such as black display and white display, and modulation of transmittance between a transparent state and a reflective state, in a region adjacent to the organic EL element 14 emitting light, without directly changing the image generated through the light emission of the organic EL element 14. The EC element 15 may perform such an enhancement on the image.

The EC element 15 may include, for example, an electrode 15A, an EC layer 15B, and an electrode 15C that are stacked in this order, on the substrate 21. The electrodes 15A and 15C may include, for example, a transparent electrically-conductive material, such as ITO or IZO. The EC layer 15B may include an electrochromic material. The electrochromic material may exhibit a reversible change in its optical property through an oxidation-reduction reaction of its electrochromic substances, and thereby change its absorption property.

In an example, the EC elements 15 may be in a transparent state (i.e., have optical transparency) while receiving no voltage, and may turn into a black or bluish-black state when receiving a voltage. In another example, the EC elements 15 may be in a white or gray state while receiving no voltage, and may turn into the black or bluish-black state when receiving a voltage. In still another example, the EC elements 15 may be in a mirror state (i.e., have optical reflectivity) while receiving a predetermined negative voltage, and may turn into the black or bluish-black state when receiving a predetermined positive voltage. In yet another example, the EC elements 15 may be in the mirror state (i.e., have optical reflectivity) while receiving a predetermined negative voltage, and may turn into the transparent state (i.e., have optical transparency) while receiving no voltage.

In an example, the EC element 15 may include a first ITO layer, an $IrO_2$ layer, a $Ta_2O_5$ layer (i.e., a solid-electrolyte layer), a $WO_3$ layer (i.e., an electrochromic-material layer), and a second ITO layer that are stacked in this order. While no voltage is applied to the EC element 15 having such a configuration, the $WO_3$ layer may be in the transparent state (i.e., have optical transparency). On the other hand, when a voltage is applied to the EC element 15 to cause the second ITO layer adjacent to the $WO_3$ layer to be at a negative voltage, the $WO_3$ layer in the transparent state may be reduced through a reaction of $WO_3+xH^++xe^-\rightarrow HxWO_3$ to turn into the black or bluish-black state, causing the EC element 15 to turn into the black or bluish-black state.

In another example, the EC element 15 may include a $TiO_2$ layer, the first ITO, the $IrO_2$ layer, the $Ta_2O_5$ layer (i.e., the solid-electrolyte layer), the $WO_3$ layer (i.e., the electrochromic-material layer), and the second ITO layer that are stacked in this order. The $TiO_2$ layer may have a white-scattering property. While no voltage is applied to the EC element 15 having such a configuration, the $WO_3$ layer may be in the transparent state (i.e., have optical transparency), whereas the EC element 15 may be in the white or gray state due to the white-scattering property of the $TiO_2$ layer. When a voltage is applied to the EC element 15 to cause the second ITO layer adjacent to the $WO_3$ layer to be at a negative voltage, the $WO_3$ layer in the transparent state may be reduced through a reaction of $WO_3+xH^++xe^-\rightarrow HxWO_3$ to turn into the black or bluish-black state, causing the EC element 15 to turn into the black or bluish-black state.

In still another example, the EC element 15 may include a reflective metal layer, the $IrO_2$ layer, the $Ta_2O_5$ layer (i.e., the solid-electrolyte layer), the $WO_3$ layer (i.e., the electrochromic-material layer), and the ITO layer that are stacked in this order. While no voltage is applied to the EC element 15 having such a configuration, the $WO_3$ layer may be in the transparent state (i.e., have optical transparency), and the EC element 15 may thus be in the mirror state (i.e., have optical reflectivity) due to light reflection by the reflective metal layer. On the other hand, when a voltage is applied to the EC element 15 to cause the ITO layer adjacent to the $WO_3$ layer to be at a negative voltage, the $WO_3$ layer in the transparent state may be reduced through a reaction of $WO_3+xH^++xe^-\rightarrow HxWO_3$ to turn into the black or bluish-black state, causing the EC element 15 to turn into the black or bluish-black state.

In yet another example, the EC element 15 may have a configuration described in "Applied physics express"; Volume 6, Issue 2, p: 026503; Feb. 1, 2013 published by the Japan Society of Applied Physics through the Institute of Pure and Applied Physics; Onodera, Ryou; Seki, Yoshiyuki; Seki, Shigeyuki; Yamada, Katsumi; Sawada, Yutaka; and Uchida, Takayuki (hereinafter referred to as "Reference 1").

In this example, one of ITO layers may be a smooth ITO layer, and the other ITO layer may be a rough ITO layer. When a predetermined positive voltage is applied to the EC element 15 having such a configuration (i.e., a positive voltage is applied to the rough ITO layer and a negative voltage is applied to the smooth ITO layer), the EC element 15 may become the mirror state (i.e., have optical reflectivity) due to deposition of Ag on the smooth ITO layer. On the other hand, while no voltage is applied to the EC element 15, the EC element 15 may be in the transparent state (i.e., have optical transparency) due to dissolution of Ag.

In this example embodiment, the EC element 15 may be provided on a plane parallel to the substrate 21 so as to surround the organic EL element 14. In other words, the organic EL element 14 and the EC element 15 may be provided on a plane parallel to the substrate 21. With reference to FIG. 4, for example, the electrode 15A of the EC element 15 may cover an end portion of the electrode 14A of a predetermined organic EL element 14. In this example embodiment, the electrode 15A of the EC element 15 may be electrically coupled to the electrode 14A of the predetermined organic EL element 14. The electrode 15A of the EC element 15 may be electrically coupled to the electrode 14A in corresponding one of the subpixels 12 (subpixel 12 that emits red light, for example) in the pixel 11. The EC element 15 may include an electrode 15D that is coupled to the switching transistor Tr4. The electrode 15D may be in contact with the electrode 15C.

Figure 5:
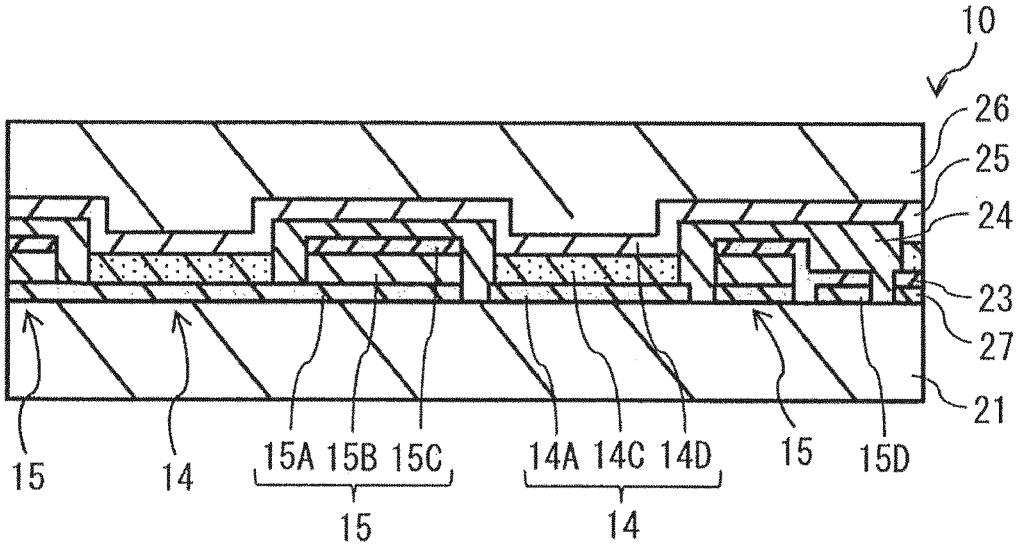
FIG. 5 is an example cross-sectional view of the organic EL panel taken along the line A-A in FIG. 3.
Figure 6:
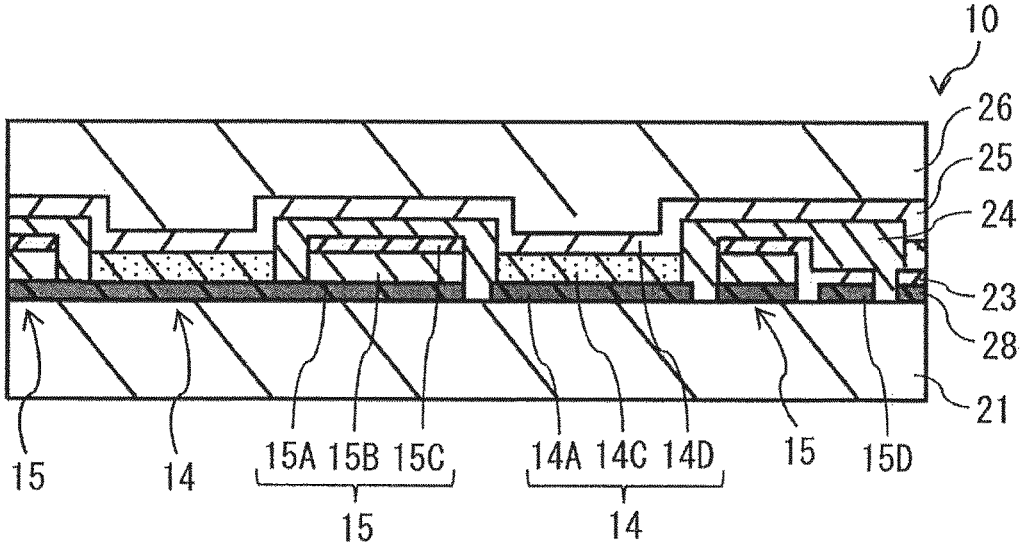
FIG. 6 is an example cross-sectional view of the organic EL panel taken along the line A-A in FIG. 3.

The organic EL panel 10 may further include a metal layer 22 in contact with the substrate 21, and an ITO layer 23 in contact with surfaces of the metal layer 22 and the EC layer 15B, for example. A portion of the metal layer 22 may serve as the electrode 14A of the organic EL element 14. Additionally, a portion of the ITO layer 23 may serve as the ITO layer 14B of the organic EL element 14, and a portion of the ITO layer 23 may serve as the electrode 15C of the EC element 15. In an example where the EC element 15 may be in the white state while receiving no voltage and the EC element 15 may become the mirror state (i.e., have optical reflectivity) when receiving a predetermined negative voltage, an ITO layer 27 may be provided in place of the metal layer 22 and the ITO layer 14B, as illustrated in FIG. 5, for example. In this example, a portion of the ITO layer 27 may serve as the electrode 14A of the organic EL element 14, and a portion of the ITO layer 27 may serve as the electrodes 15A and 15D of the EC element 15. In an alternative example, a metal layer 28 may be provided in place of the ITO layer 27, as illustrated in FIG. 6. In this example, a portion of the metal layer 28 may serve as the electrode 14A of the organic EL element 14, and a portion of the metal layer 28 may serve as the electrodes 15A and 15D of the EC element 15.

The organic EL panel 10 may further include an insulating layer 24 on the substrate 21. The insulating layer 24 may suppress or prevent electrical short-circuiting between the electrode 15C of the EC element 15 and the ITO layer 14D of the organic EL element 14. The insulating layer 24 may include, for example, SiN, SiON, or SiOx. The organic EL panel 10 may further include a sealing layer 26 on the substrate 21. The sealing layer 26 may seal each of the organic EL elements 14 and each of the EC elements 15. The sealing layer 26 may include, for example, an organic material, such as epoxy resin and vinyl resin.

[Operations]

An example operation of the display unit 1 according to the example embodiment of the disclosure will now be described.

Described below is the operation of the display unit 1 according to this example embodiment in which each of the EC elements 15 includes $WO_3$ as the electrochromic material and no $TiO_2$ layer having the white scattering property. While no voltage is applied to the EC elements 15, the EC elements 15 may be in a transparent state, as illustrated on the left of FIG. 7, for example. When the signal voltage Vsig2 is applied to some of the EC elements 15 in the transparent state, the EC elements 15 receiving the signal voltage Vsig2 may change from the transparent state to the black or bluish-black state, as illustrated on the right of FIG. 7. When the application of voltage to some of the EC elements 15 is halted, the EC elements 15 in the black or bluish-black state may turn into the transparent state, as illustrated on the left of FIG. 7, for example.

Described below is the operation of the display unit 1 according to this example embodiment in which each of the EC elements 15 includes $WO_3$ as the electrochromic material and a $TiO_2$ layer having the white scattering property. While no voltage is applied to the EC elements 15, the EC elements 15 may be in the white or gray state, as illustrated on the left of FIG. 8, for example. When the signal voltage Vsig2 is applied to some of the EC elements 15 in the white or gray state, the EC elements 15 receiving the signal voltage Vsig2 may change from the white or gray state to the black or bluish-black state, as illustrated on the right of FIG. 8, for example. When the application of voltage to some of the EC elements 15 is halted, the EC elements 15 in the black or bluish-black state may turn into the white or gray state, as illustrated on the left of FIG. 8, for example.

Described below is the operation of the display unit 1 according to this example embodiment in which each of the EC elements 15 includes $WO_3$ as the electrochromic material and no $TiO_2$ layer having the white scattering property, and each of the electrodes 15A includes a metal material having high reflectivity. While no voltage is applied to the EC elements 15, the EC layers 15B in the respective EC elements 15 may be in the transparent state, and the EC elements 15 may be in the mirror state (i.e., have optical reflectivity) due to the reflectivity of the electrodes 15A, as illustrated on the left of FIG. 9. When the signal voltage Vsig2 is applied to some of the EC elements 15 in the mirror state (i.e., the EC elements 15 having optical reflectivity), the EC elements 15 receiving the signal voltage Vsig2 may change from the mirror or light-reflective state to the black or bluish-black state, as illustrated on the right of FIG. 9, for example. When the application of voltage to some of the EC elements 15 is halted, the EC elements in the black or bluish-black state may turn into the mirror or light-reflective state, as illustrated on the left of FIG. 9.

Described below is the operation of the display unit 1 according to this example embodiment in which each of the EC elements 15 has the configuration described in Reference 1 described above, one of the ITO layers is a smooth ITO layer, and the other ITO layer is a rough ITO layer. When a predetermined positive voltage, which corresponds to the signal voltage Vsig 2, is applied to the EC elements 15 (i.e., a positive voltage is applied to the rough ITO layer and a negative voltage is applied to the smooth ITO layer), the EC elements 15 may become the mirror (i.e., have optical reflectivity), as illustrated on the left of FIG. 9, for example. When a predetermined negative voltage, which corresponds to the signal voltage Vsig 2, is applied to the EC elements 15 in the mirror or light-reflective state (i.e., a negative voltage is applied to the rough ITO layer and a positive voltage is applied to the smooth ITO layer), the EC elements 15 in the mirror or light-reflective state may turn into the black or bluish-black state, as illustrated on the right of FIG. 9, for example. When a predetermined positive voltage, which corresponds to the signal voltage Vsig 2, is applied to the EC elements 15 in the black or bluish-black state (i.e., a positive voltage is applied to the rough ITO layer and a negative voltage is applied to the smooth ITO layer), the EC elements 15 in the black or bluish-black state may turn into the mirror (i.e., have optical reflectivity), as illustrated on the left of FIG. 9.

Described below is the operation of the display unit 1 according to this example embodiment in which each of the EC elements 15 has the configuration described in Reference 1 described above, one of the ITO layers is a smooth ITO layer, and the other ITO layer is a rough ITO layer. When a predetermined positive voltage, which corresponds to the signal voltage Vsig2, is applied to the EC elements 15 (i.e., a positive voltage is applied to the rough ITO layer and a negative voltage is applied to the smooth ITO layer), the EC elements 15 may become the mirror (i.e., have optical reflectivity), as illustrated on the left of FIG. 10, for example. When the signal voltage Vsig2 of 0 volts is applied to the EC elements 15 in the mirror or light-reflective state (i.e., the voltage of 0 volts is applied to both the rough ITO layer and the smooth ITO layer), the EC elements 15 in the mirror or light-reflective state may turn into the transparent state (i.e., have optical transparency), as illustrated on the right of FIG. 10, for example. When a predetermined positive voltage, which corresponds to the signal voltage Vsig2, is applied to the EC elements 15 in the transparent state (i.e., a positive voltage is applied to the rough ITO layer and a negative voltage is applied to the smooth ITO layer), the EC elements 15 in the transparent state (i.e., the EC elements 15 having optical transparency) may turn into the mirror state (i.e., may have optical reflectivity), as illustrated on the left of FIG. 10, for example.

[Manufacturing Method]

Described below is a method of manufacturing the organic EL panel 10 according to the example embodiment of the disclosure. FIGS. 11 and 12 illustrate an example procedure for manufacturing the organic EL panel 10. Note that FIGS. 11 and 12 each illustrate a cross-sectional configuration of the organic EL panel 10 taken along the line A-A in FIG. 3.

Figure 11A:
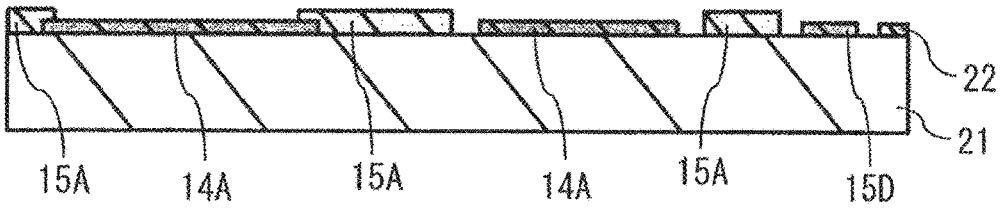
FIGS. 11A to 11D are diagrams illustrating example manufacturing processes for the organic EL panel of FIG. 3.
Figure 11B:
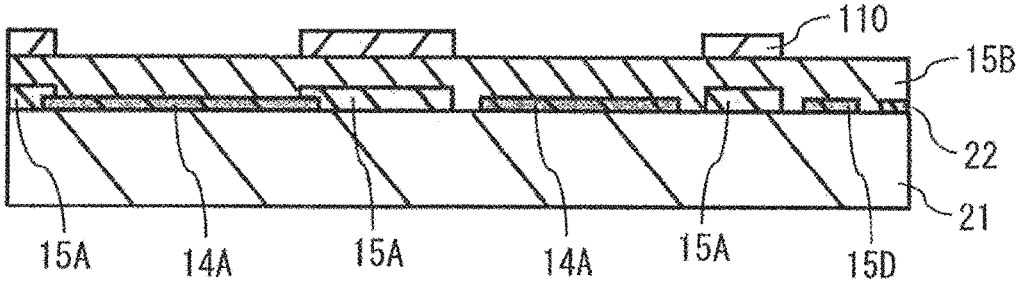
Figure 11C:
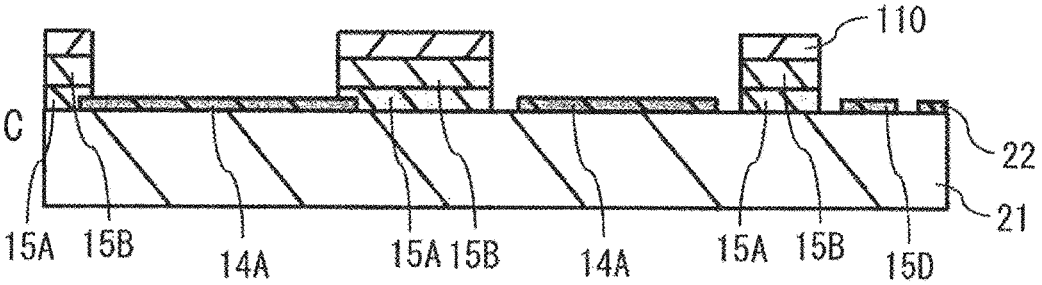
Figure 11D:
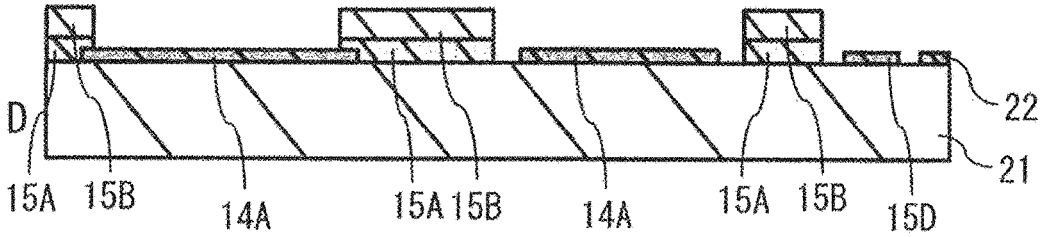

Firstly, the metal material may be formed into a film on the substrate 21, and the film may be subjected to patterning, for example, to form the electrodes 14A and 15D on the substrate 21, as illustrated in FIG. 11A. Thereafter, the ITO layer may be formed over the entire surface of the substrate 21 on which the electrodes 14A and 15D are provided, and the ITO layer may be subjected to patterning, for example, to form the electrode 15A, as illustrated in FIG. 11A. Thereafter, with reference to FIG. 11B, the EC layer 15B may be formed over the entire surface of the substrate 21, and a resist layer 110 may be formed only on the electrode 15A. The EC layer 15B may be selectively etched with the use of the resist layer 110 as a mask. The etching may be performed using an etchant with which the EC layer 15B is etched at a higher etching rate than the electrode 14A is. For example, to form a laminate structure of the metal-based electrodes 14A and 15D and the ITO layer, the etching may be performed using an etchant with which the EC layer 15B is etched at a higher etching rate than the ITO layer is. Through these processes, the EC layer 15B may be formed only on the electrode 15A, as illustrated in FIG. 11C. Thereafter, the resist layer 110 may be removed, as illustrated in FIG. 11D.

Figure 12A:
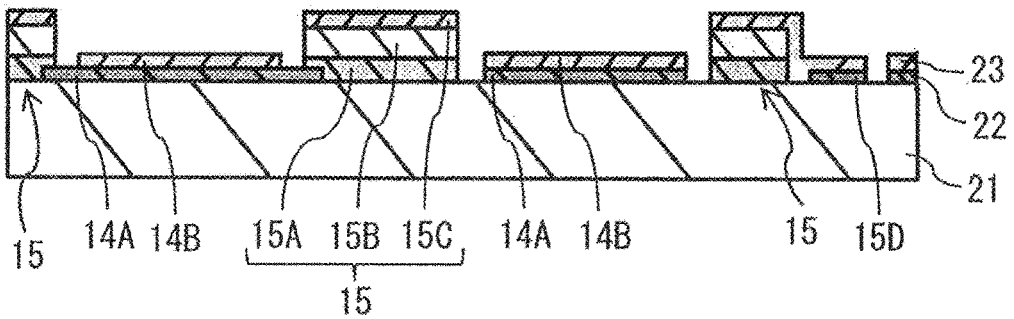
FIGS. 12A to 12C are diagrams illustrating example manufacturing processes subsequent to the manufacturing process illustrated in FIG. 11D.
Figure 12B:
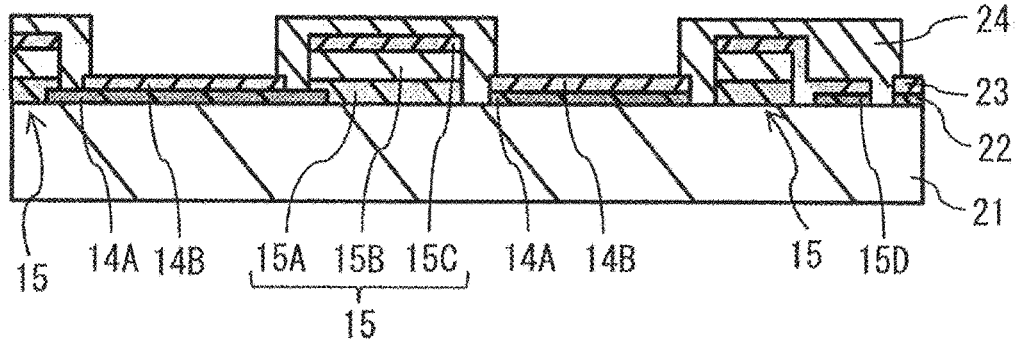
Figure 12C:
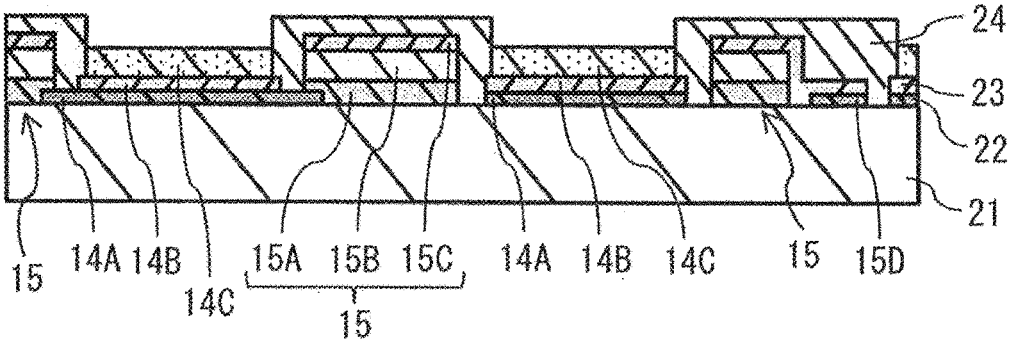

Thereafter, with reference to FIG. 12A, the ITO layer 23 may be formed on surfaces of the EC layer 15B and the electrode 14A, thereby forming the EC elements 15. Thereafter, with reference to FIG. 12B, the insulating layer 24 may be formed to cover each of the EC elements 15. Thereafter, with reference to FIG. 12C, the EL layer 14C may be formed on a surface of the ITO layer 23 on the electrode 14A. Thereafter, the ITO layer 25 (refer to FIG. 4, for example) may be formed over the entire display region that includes the surface of each EL layer 14C, thereby forming the organic EL elements 14. Finally, the sealing layer 26 may be formed. The organic EL panel 10 may be manufactured through these processes described above.

[Operation of Pixel]

Figure 13:
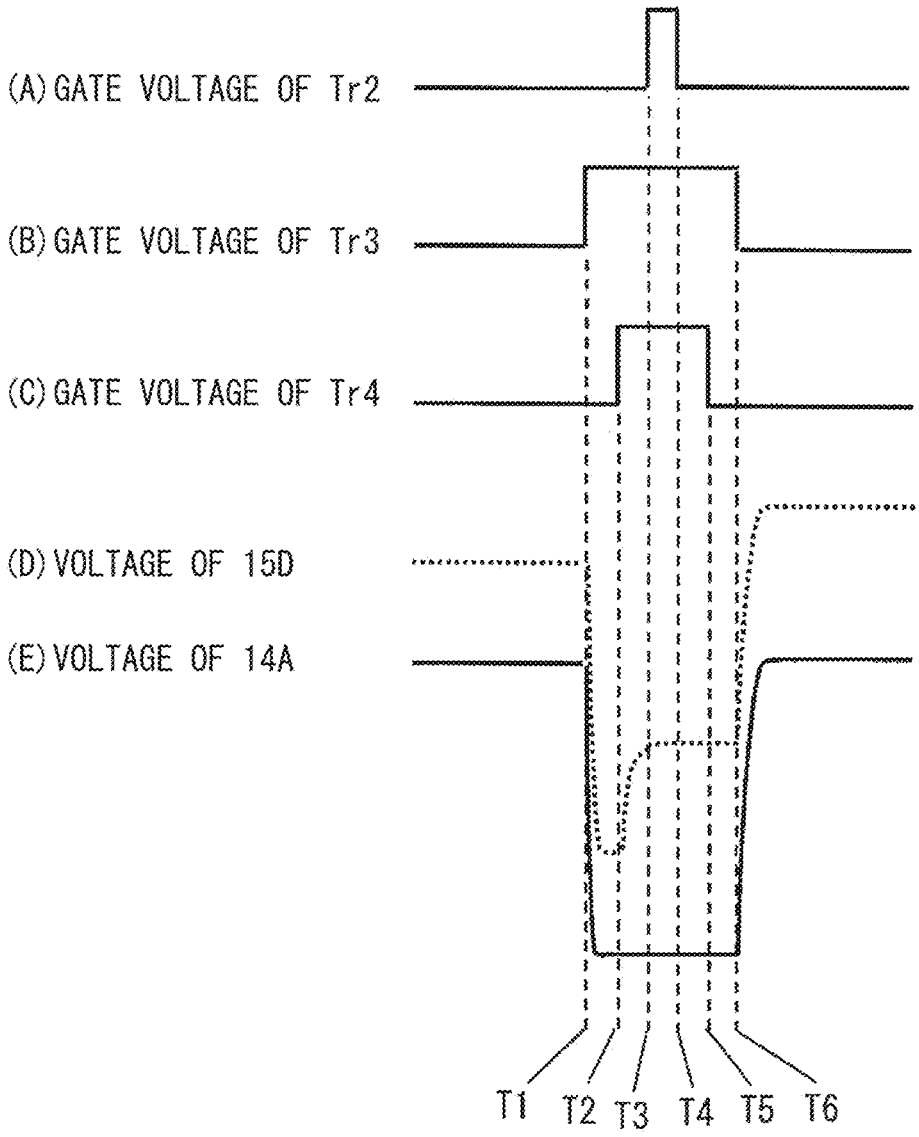
FIG. 13 is a diagram illustrating example waves of various voltages applied to the organic EL panel of FIG. 3 and example waves of various voltages generated in the organic EL panel of FIG. 3.

The operation of each of the pixels 11 in the organic EL panel 10 according to the example embodiment of the disclosure will now be described. FIG. 13 illustrates example waves of various voltages applied to the organic EL panel 10, and example waves of various voltages generated in the organic EL panel 10.

In this embodiment, the switching transistor Tr3, the switching transistor Tr4, and the writing transistor Tr2 may be turned on in this order, and the writing transistor Tr2, the switching transistor Tr4, and the switching transistor Tr3 may be turned off in this order. This allows for writing of the signal voltage Vsig to a gate of the driving transistor Tr1, at the same time as the application of a predetermined voltage to each of the EC elements 15. The ON-operation in this order suppresses abnormal electric charging to each of the EC elements 15. Alternatively, the switching transistor Tr3, the switching transistor Tr4, and the writing transistor Tr2 may be turned on at the same time. Still alternatively, the switching transistor Tr3 and the switching transistor Tr4 may be turned on after the writing transistor Tr2 is turned on.

In this example embodiment, light emission by the organic EL element 14 may be performed after the writing of the signal voltage Vsig and the application of voltage to the EC element 15. In other words, the EC element 15 and the organic EL element 14 are selectively driven, in this embodiment.

Example Effects

Some effects of the display unit 1 according to the example embodiment of the disclosure will now be described.

In the example embodiment, the organic EL element 14 and the EC element 15 are selectively driven by the pixel circuit 13. This allows the display unit 1 to display an image using the organic EL elements 14 and at the same time perform the enhancement of the image using the EC elements 15, as illustrated in FIGS. 7 to 10, for example. Accordingly, it is possible to achieve novel image-display representation.

In the example embodiment, the organic EL element 14 and the EC element 15 may be coupled in parallel to each other, and the electric current path P1 of the electric current flowing through the organic EL element 14 may intersect with the electric current path P2 of the electric current flowing through the EC element 15, at a node between the organic EL element 14 and the EC element 15. This allows the display unit 1 to display an image using the organic EL elements 14 and at the same time perform the enhancement of the image using the EC elements 15, as illustrated in FIGS. 7 to 10, for example. Accordingly, it is possible to achieve novel image-display representation.

In the example embodiment, the organic EL element 14 and the EC element 15 may be provided on a plane parallel to the substrate 21. This allows the organic EL element 14 and the EC element 15 to be formed in a common manufacturing process, which results in a reduction in manufacturing costs.

In the example embodiment, the EC element 15 may be shared between the subpixels 12 adjacent to each other. This configuration allows the EC element 15 to be driven by a simple way, compared with the configuration in which the EC element 15 is provided for each of the subpixels 12. Accordingly, it is possible to reduce a cost for the display unit 1.

Figure 7:
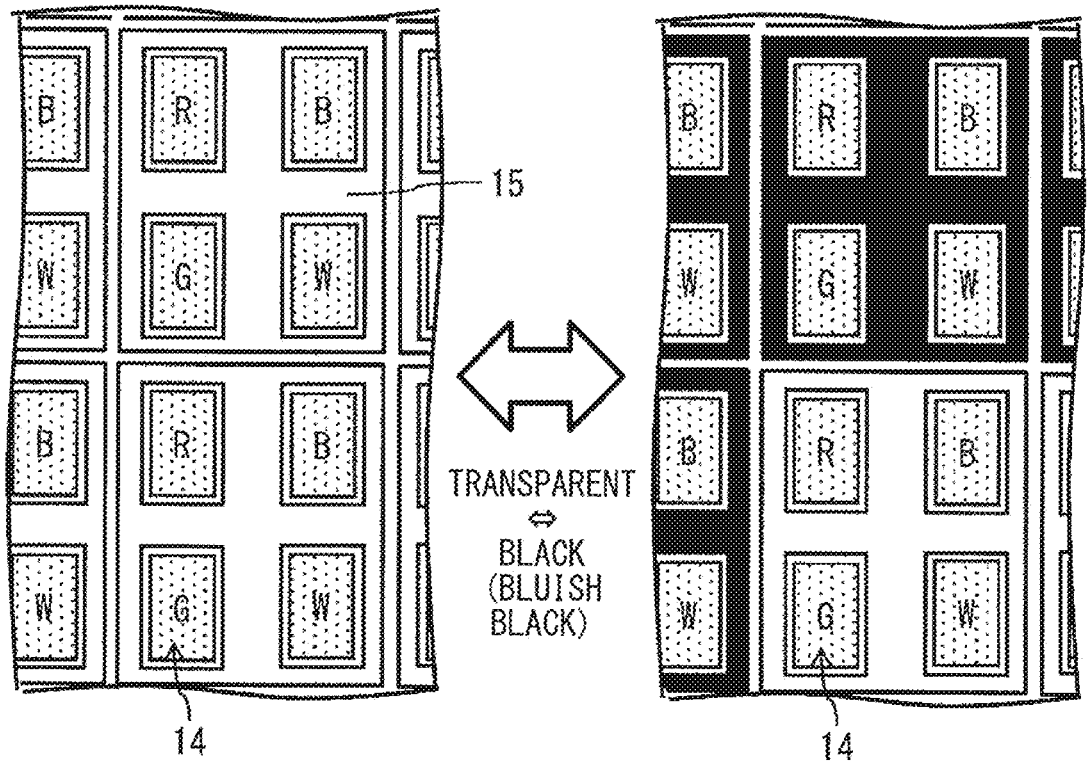
FIG. 7 is a schematic view of the organic EL panel of FIG. 3 for illustrating example image enhancement according to one embodiment of the disclosure.

In the example embodiment, some of the EC elements 15 in the display region of the organic EL panel 10 may change from the transparent state to the black or bluish-black state, as illustrated in FIG. 7, for example. This allows an image that is displayed on the transparent organic EL panel 10 using the organic EL elements 14 to be adjusted in contrast. Accordingly, it is possible to achieve novel image-display representation.

Figure 8:
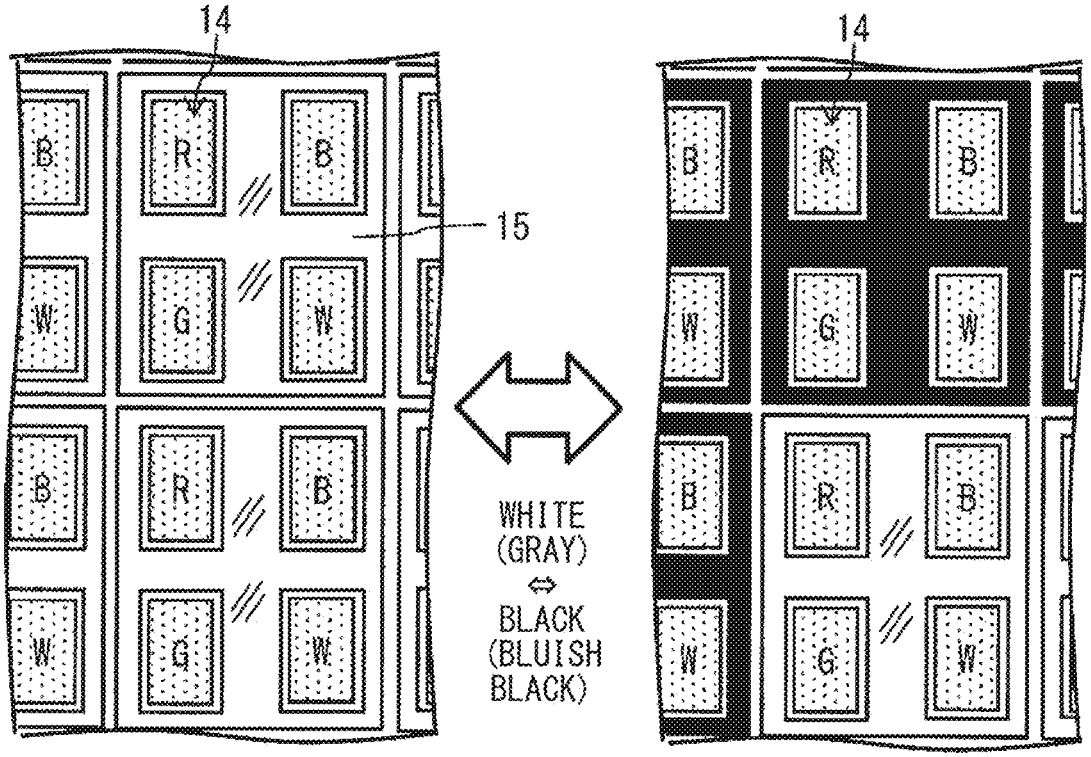
FIG. 8 is a schematic view of the organic EL panel of FIG. 3 for illustrating example image enhancement according to one embodiment of the disclosure.

In the example embodiment, some of the EC elements 15 in the display region of the organic EL panel 10 may change from the white or gray state to the black or bluish-black state, as illustrated in FIG. 8, for example. This allows an image that is displayed on the organic EL panel 10 using the organic EL elements 14 to be adjusted in contrast. Accordingly, it is possible to achieve novel image-display representation. In another example embodiment of the disclosure, only the EC elements 15 that have memory functionality may be driven by an extremely low electric power to change a panel color from white to gray. This mitigates an oppressive appearance of a typical black panel that appears when the image disappears. Additionally, image displaying in white and black colors is able to be achieved using only the EC elements 15. This allows an image such as a wallpaper to be displayed by an extremely low electrical power.

Figure 9:
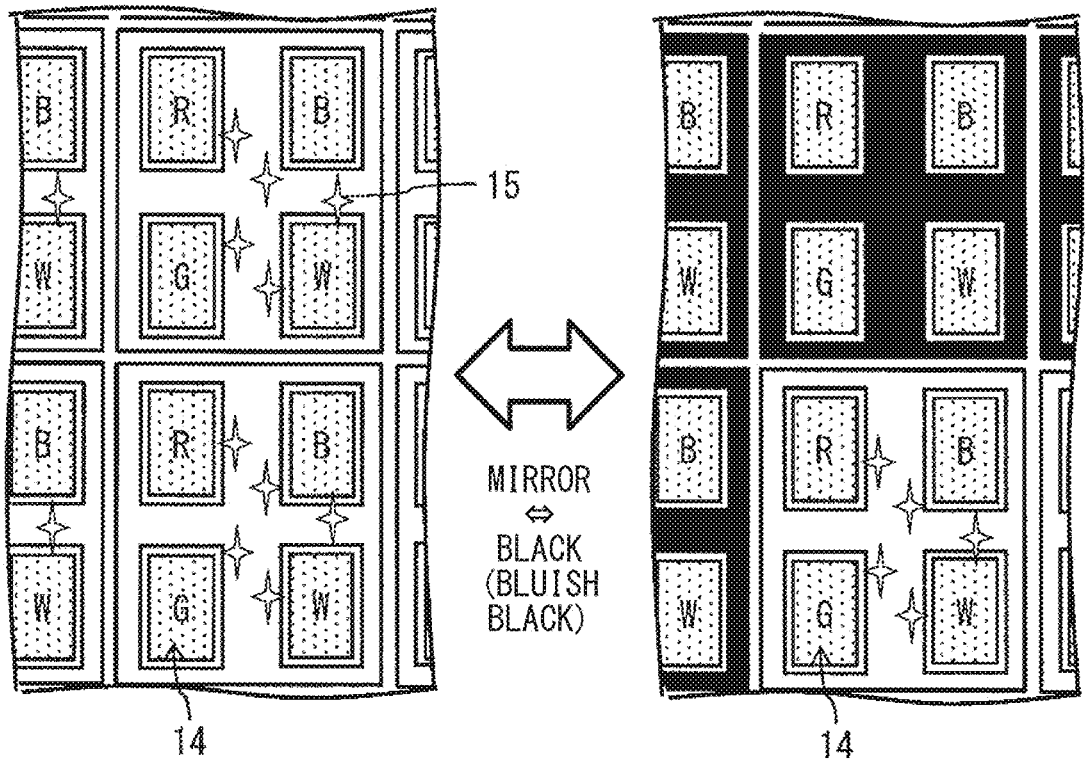
FIG. 9 is a schematic view of the organic EL panel of FIG. 3 for illustrating example image enhancement according to one embodiment of the disclosure.
Figure 10:
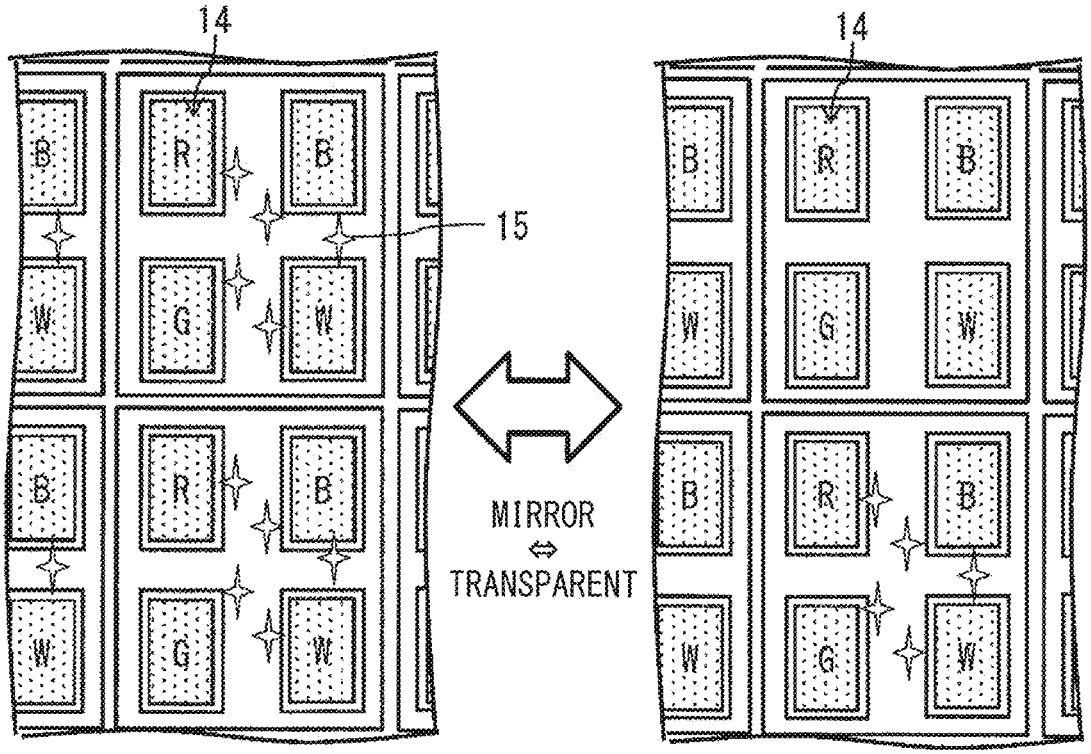
FIG. 10 is a schematic view of the organic EL panel of FIG. 3 for illustrating example image enhancement according to one embodiment of the disclosure.

In the example embodiment, some of the EC elements 15 in the display region of the organic EL panel 10 may change from the mirror or light-reflective state to the black or bluish-black state, as illustrated in FIG. 9, for example. This allows an image that is displayed on the organic EL panel 10 using the EL elements 14 to be adjusted in contrast. Accordingly, it is possible to achieve novel image-display representation. In the example embodiment, some of the EC elements 15 in the display region of the organic EL panel 10 may change from the mirror or light-reflective state to the transparent or light-transmissive state, and from the transparent or light-transmissive state to the mirror or light-reflective state, as illustrated in FIG. 10, for example. This allows the organic EL panel 10 to serve as a mirror display or a transparent display. Accordingly, it is possible to achieve novel image-display representation.

2. Modification Examples

Some modification examples of the organic EL panel 10 according to the foregoing example embodiment will now be described.

Modification Example A

Figure 14:
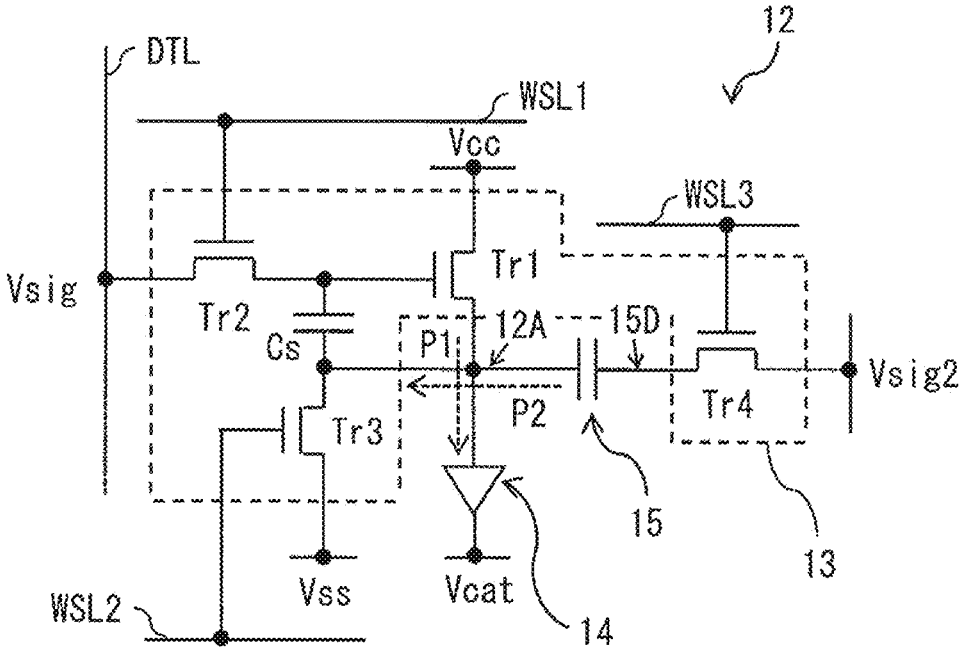
FIG. 14 is an example circuit diagram of a subpixel included in each pixel illustrated in FIG. 1 according to one modification example of the disclosure.

FIG. 14 illustrates Modification Example A of the circuit configuration of the subpixel 12 included in each of the pixels 11 in the organic EL panel 10 according to the foregoing example embodiment of the disclosure. In Modification Example A, the driving transistor Tr1 may be an n-channel transistor. The storage capacitor Cs may be coupled to the gate of the driving transistor Tr1 and the anode of the organic EL element 14. Also in Modification Example A, the electric current path P1 may intersect with the electric current path P2, at the node between the EC element 15 and the organic EL element 14. This allows the pixel circuit 13 to selectively drive the organic EL element 14 and the EC element 15. Accordingly, it is possible for the display unit 1 of Modification Example A to provide a similar or the same effects as those of the foregoing example embodiments.

Figure 15:
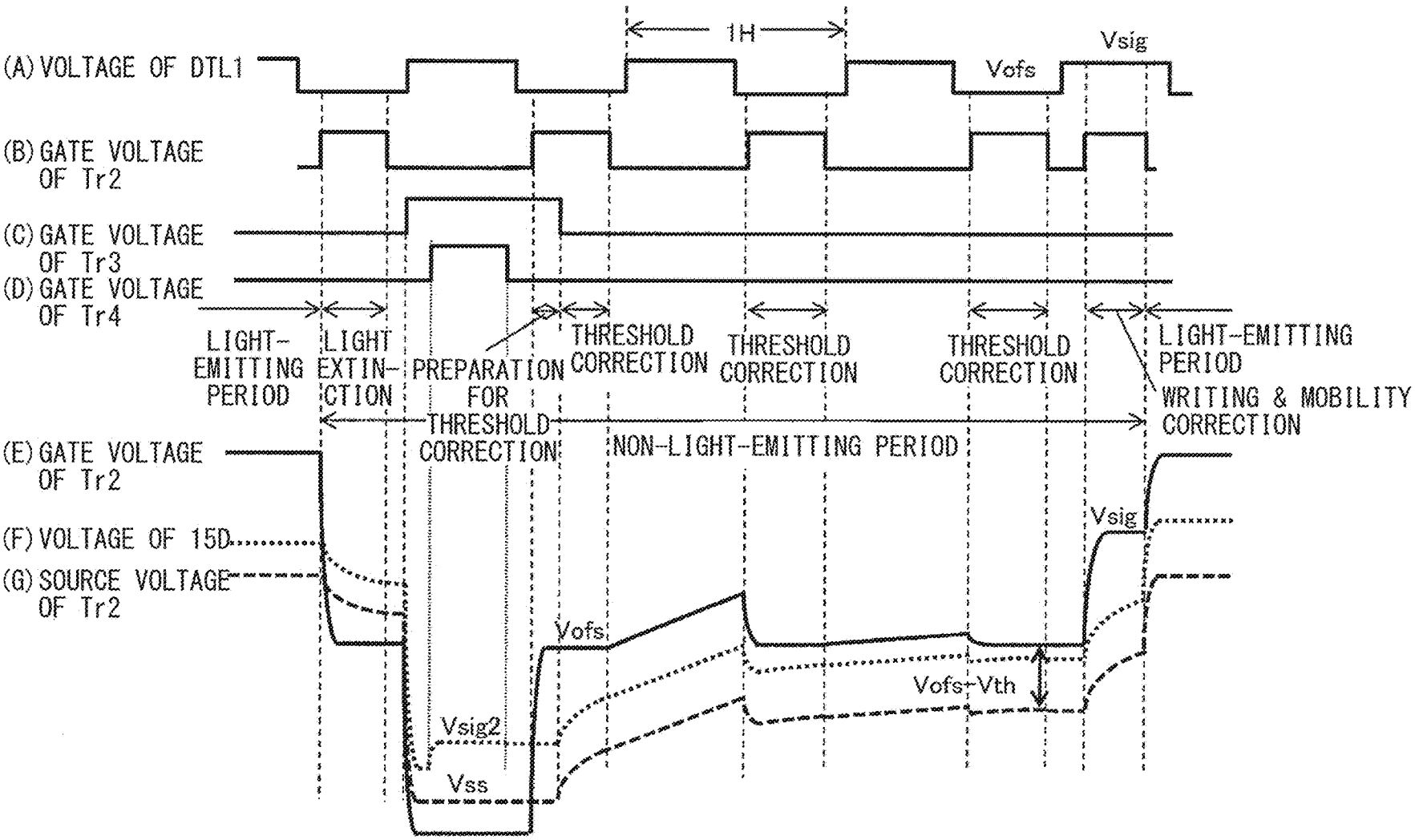
FIG. 15 is a diagram illustrating example waves of various voltages applied to an organic EL panel provided with the subpixels illustrated in FIG. 14 and example waves of various voltages generated in the organic EL panel provided with the subpixels illustrated in FIG. 14.

Additionally, in Modification Example A, the controller 20 and the driver 30 may perform a threshold correction of the driving transistor Tr1 in each of the subpixels 12, as illustrated in FIG. 15, for example. The term "threshold correction" as used herein refers to an operation for correcting the gate-source voltage of the driving transistor Tr1 close to a threshold voltage of the driving transistor Tr1. Referring to driving timings illustrated in FIG. 15, the switching transistors Tr3 and Tr4 may be turned on before a preparation time for the threshold correction, and voltages Vss and Vsig2 are thereby applied to respective terminals of the EC element 15. Thereafter, the threshold correction and signal writing may be performed to cause the organic EL elements 14 to emit light. The voltage application to each of the EC elements 15 before the threshold correction allows each of the EC elements 15 to be supplied with the constant voltage regardless of a fluctuation of the source potential of the driving transistor Tr1 caused by the threshold correction.

In Modification Example A that involves the threshold correction of the driving transistor Tr1 in each of the subpixels 12, it is possible to achieve image display representation with higher display quality.

Modification Example B

Figure 16:
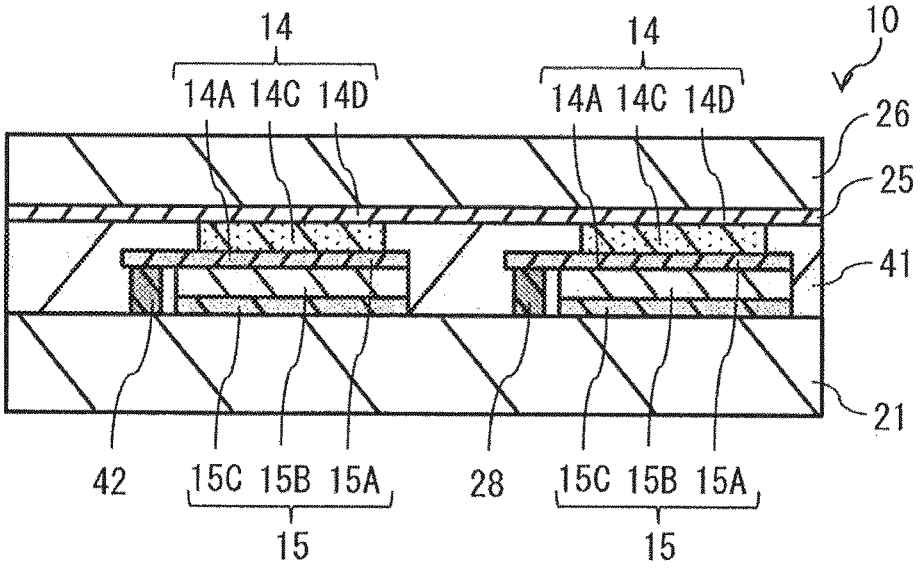
FIG. 16 is an example cross-sectional view of the organic EL panel taken along the line A-A in FIG. 3 according to one modification example of the disclosure.

FIG. 16 illustrates Modification Example B of the cross-sectional configuration of the organic EL panel 10 according to the foregoing example embodiment of the disclosure. In Modification Example B, the organic EL element 14 and the EC element 15 may be laminated to each other. For example, the organic EL element 14 may be provided on the EC element 15, as illustrated in FIG. 16. The EC element 15 may be provided so as to face the entire light emission region of the organic EL element 14, when seen from the normal direction of the substrate 21. In Modification Example B, the EC element 15 may be provided so as to face a portion (e.g., a central portion) of the light emission region of the organic EL element 14, as illustrated in FIG. 16. Additionally, the organic EL element 14 and the EC element 15 may be embedded in the insulating layer 41, as illustrated in FIG. 16, for example. In this example, a common electrode serving as the electrode 15A of the EC element 15 and the electrode 14A of the organic EL element 14 may be provided, and a connection 42 serving as a lead-out wiring line may be provided in the insulating layer 41 and electrically coupled to the common electrode serving as the electrode 15A and the electrode 14A. This configuration allows the EC element 15 and the organic EL element 14 to be densely provided, compared with a configuration in which the EC element 15 and the organic EL element 14 are provided in a common layer. Accordingly, it is possible to achieve image display representation with higher resolution.

[Operations]

The operation of the display unit 1 according to Modification Example B will now be described.

Figure 17:
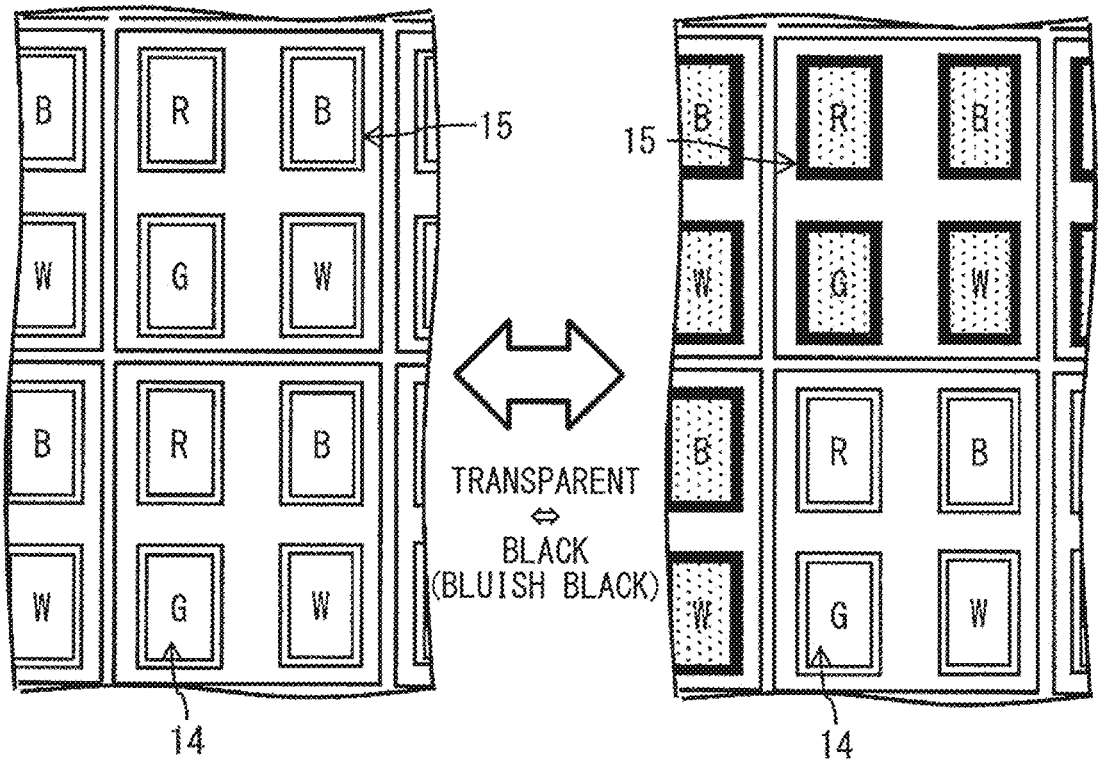
FIG. 17 is a schematic view of the organic EL panel of FIG. 16 for illustrating example image enhancement according to one embodiment of the disclosure.

Described below is the operation of the display unit 1 according to Modification Example B in which each of the EC elements 15 includes $WO_3$ as the electrochromic material and no $TiO_2$ layer having the white scattering property, and the electrodes 15A and 15D of each of the EC elements 15 may include a transparent electrically-conductive material, such as ITO or IZO. While no voltage is applied to the EC elements 15 and the organic EL elements 14, the organic EL elements 14 may be in a transparent state and the EC elements 15 immediately below the respective organic EL elements 14 in the transparent state may be in a transparent state, as illustrated on the left of FIG. 17, for example. Referring to FIG. 17, the organic EL elements 14 without dots are not emitting light and are in the transparent state. When the signal voltage Vsig is applied to some of the organic EL elements 14 and the signal voltage Vsig2 is applied to some of the EC elements 15, the organic EL elements 14 receiving the signal voltage Vsig may emit light and the EC elements 15 receiving the signal voltage Vsig2 may change from the transparent state to the black or bluish-black state, as illustrated on the right of FIG. 17, for example. Referring to FIG. 17, the organic EL elements 14 with dots are emitting light. When the application of voltage to some of the organic EL elements 14 and some of the EC elements 15 is halted, the organic EL elements 14 emitting light may stop emitting light and turn into the transparent state, and the EC elements 15 in the black or bluish-black state may turn into the transparent state, as illustrated on the left of FIG. 17, for example.

Figure 18:
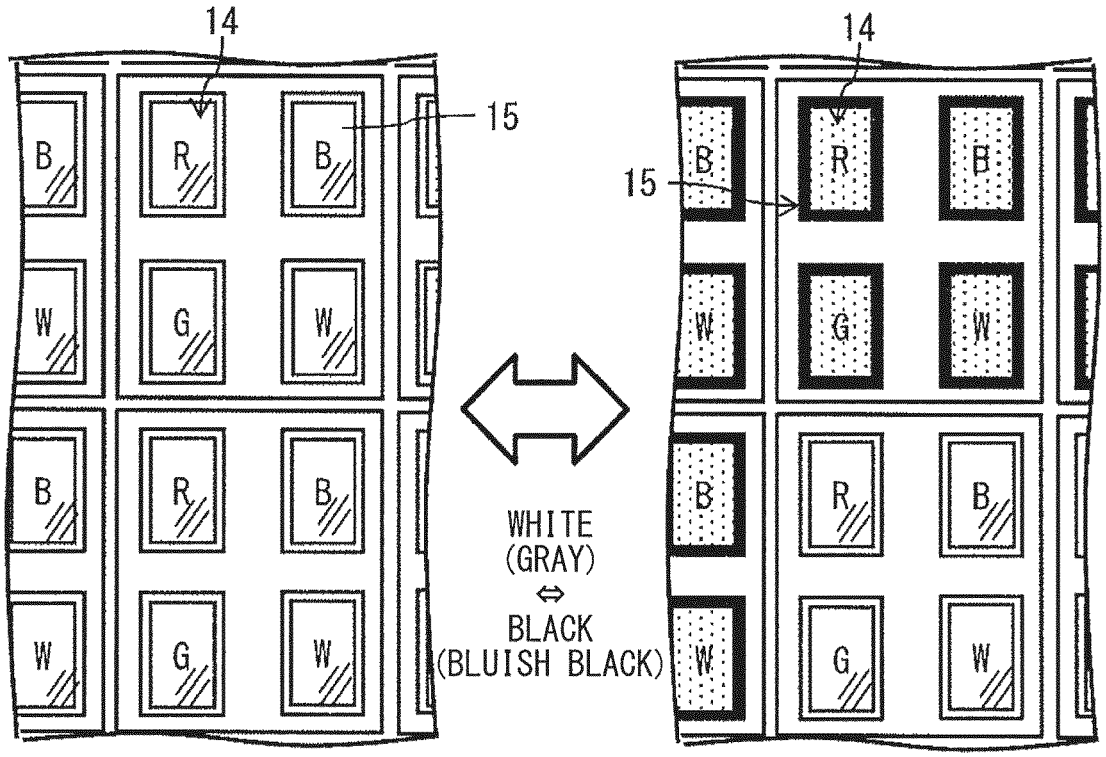
FIG. 18 is a schematic view of the organic EL panel of FIG. 16 for illustrating example image enhancement according to one embodiment of the disclosure.

Described below is the operation of the display unit 1 according to Modification Example B in which each of the EC elements 15 includes $WO_3$ as the electrochromic material and a $TiO_2$ layer having the scattering property. While no voltage is applied to the EC elements 15 and the organic EL elements 14, the organic EL elements 14 may be in a transparent state and the EC elements 15 immediately below the respective organic EL elements 14 may be in a white or gray state, as illustrated on the left of FIG. 18, for example. When the signal voltage Vsig is applied to some of the organic EL elements 14 and the signal voltage Vsig2 is applied to some of the EC elements 15, the organic EL elements 14 receiving the signal voltage Vsig may emit light, and the EC elements 15 receiving the signal voltage Vsig2 may change from the white or gray state to the black or bluish-black state, as illustrated on the right of FIG. 18, for example. When the application of voltage to some of the organic EL elements 14 and some of the EC elements 15 is halted, the organic EL elements 14 emitting light may stop emitting light and turn into the transparent state, and the EC element 15 in the black or bluish-black state may turn into the white or gray state, as illustrated on the left of FIG. 18, for example.

Figure 19:
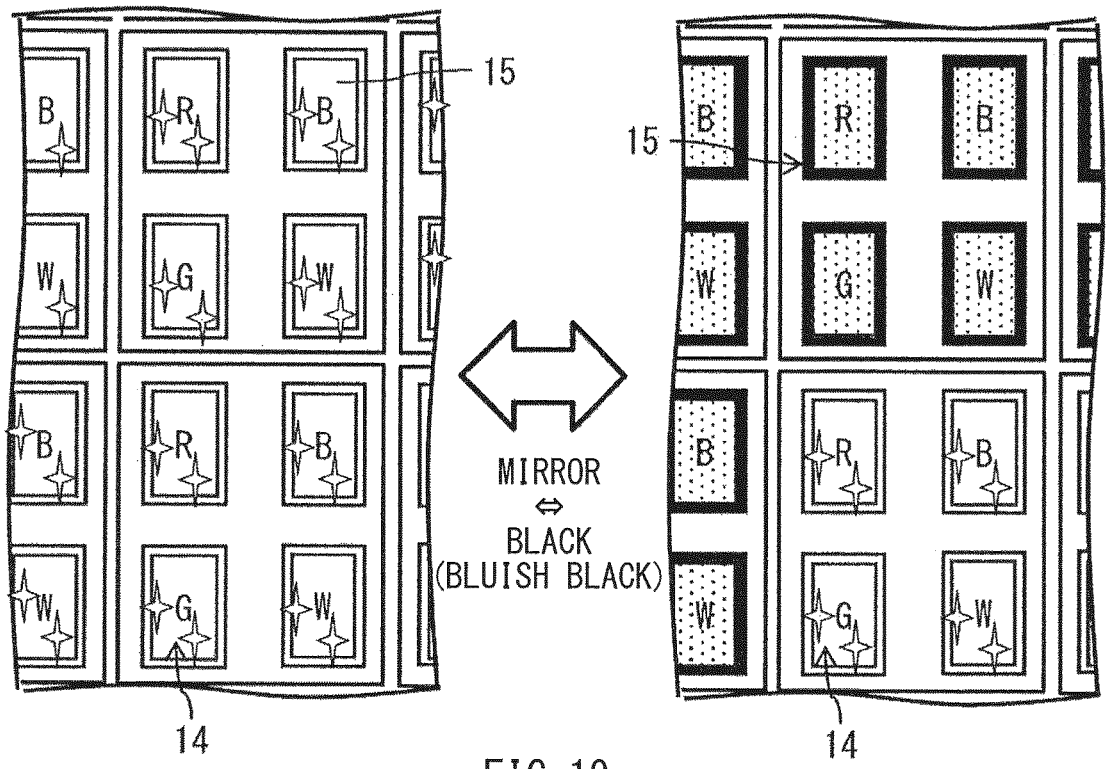
FIG. 19 is a schematic view of the organic EL panel of FIG. 16 for illustrating example image enhancement according to one embodiment of the disclosure.

Described below is the operation of the display unit 1 according to Modification Example B in which each of the EC elements 15 includes $WO_3$ as the electrochromic material and no $TiO_2$ layer having the white scattering property, and each of the electrodes 15C includes a metal material having high reflectivity. While no voltage is applied to the EC elements 15 and the organic EL elements 14, the organic EL elements 14 may be in the transparent state, and the EC elements 15 immediately below the respective organic EL element 14 in the transparent state may be in the mirror state (i.e., have optical reflectivity) due to the reflectivity of the electrode 15C, as illustrated on the left of FIG. 19, for example. Referring to FIG. 19, the EC elements 15 with stars are in the mirror state. When the signal voltage Vsig is applied to some of the organic EL elements 14 and the signal voltage Vsig2 is applied to some of the EC elements 15, the organic EL elements 14 receiving the signal voltage Vsig may emit light and the EC elements 15 receiving the signal voltage Vsig2 may change from the mirror or light-reflective state to the black or bluish-black state, as illustrated on the right of FIG. 19, for example. When the application of voltage to some of the organic EL elements 14 and to some of the EC elements 15 is halted, the organic EL elements 14 emitting light may stop emitting light and turn into the transparent state, and the EC elements 15 in the black or bluish-black state may turn into the mirror state (i.e., have optical reflectivity), as illustrated on the left of FIG. 19, for example.

Described below is the operation of the display unit 1 according to Modification Example B in which each of the EC elements 15 has the configuration described in Reference 1 described above, one of the ITO layers is a smooth ITO layer, and the other ITO layer is a rough ITO layer. When a predetermined positive voltage, which corresponds to the signal voltage Vsig 2, is applied to the EC elements 15 (i.e., a positive voltage is applied to the rough ITO layer and a negative voltage is applied to the smooth ITO layer), and no voltage is applied to the organic EL elements 14, the organic EL elements 14 may be in the transparent state, and the EC elements 15 immediately below the respective organic EL elements 14 in the transparent state may be in the mirror state (i.e., have optical reflectivity), as illustrated on the left of FIG. 19, for example. When the signal voltage Vsig is applied to some of the organic EL elements 14, and a predetermined negative voltage, which corresponds to the signal voltage Vsig2, is applied to some of the EC elements 15 (i.e., a negative voltage is applied to the rough ITO layer and a positive voltage is applied to the smooth ITO layer), the organic EL elements 14 receiving the signal voltage Vsig may emit light, and the EC elements 15 receiving the signal voltage Vsig2 may change from the mirror or light-reflective state to the black or bluish-black state, as illustrated on the right of FIG. 19, for example. When the application of voltage to some of the organic EL elements 14 is halted and a predetermined positive voltage, which corresponds to the signal voltage Vsig2, is applied to some of the EC elements 15 (i.e., a positive voltage is applied to the rough ITO layer and a negative voltage is applied to the smooth ITO layer), the organic EL elements 14 emitting light may stop emitting light and turn into the transparent state, and the EC elements 15 in the black or bluish-black state may turn into the mirror state (i.e., have optical reflectivity), as illustrated on the left of FIG. 19, for example.

Figure 20:
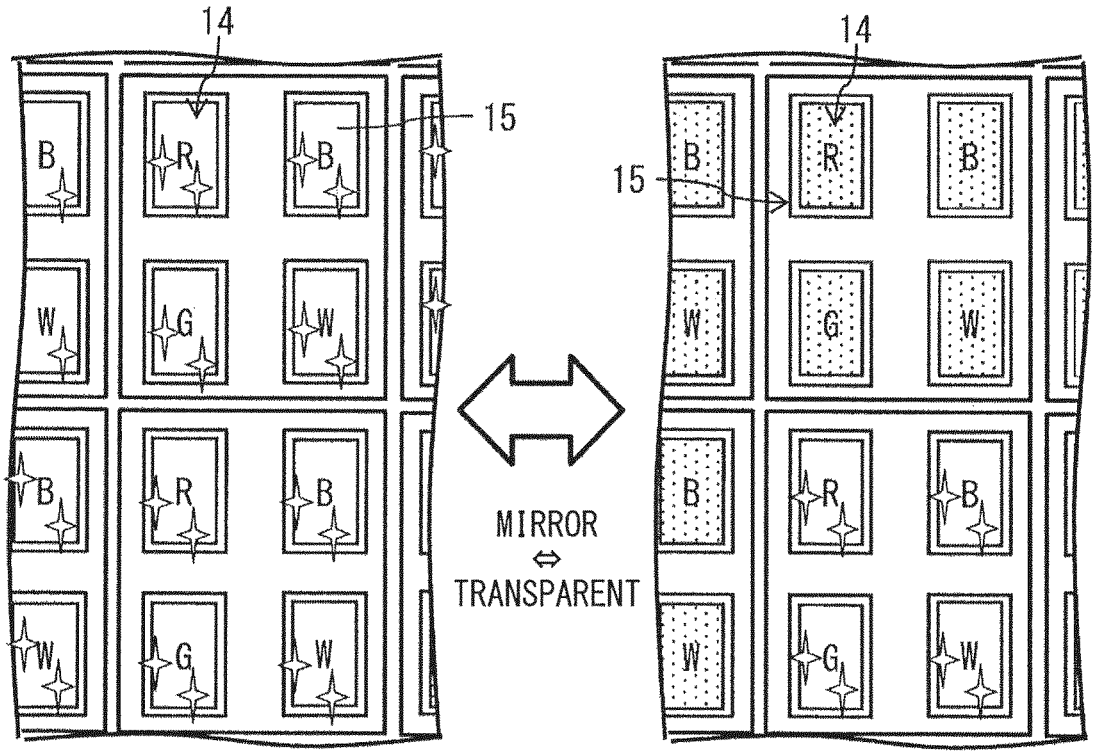
FIG. 20 is a schematic view of the organic EL panel of FIG. 16 for illustrating example image enhancement according to one embodiment of the disclosure.

Described below is the operation of the display unit 1 according to Modification Example B in which each of the EC elements 15 has the configuration described in Reference 1 described above, one of the ITO layers is a smooth ITO layer, and the other ITO layer is a rough ITO layer. When a predetermined positive voltage, which corresponds to the signal voltage Vsig2, is applied to the EC elements 15 (i.e., a positive voltage is applied to the rough ITO layer and a negative voltage is applied to the smooth ITO layer), and no voltage is applied to the organic EL elements 14, the organic EL elements 14 may be in the transparent state and the EC elements 15 immediately below the respective organic EL elements 14 in the transparent state may be in the mirror state (i.e., have optical reflectivity), as illustrated on the left of FIG. 20, for example. When the signal voltage Vsig is applied to some of the organic EL elements 14 and the signal voltage Vsig2 of 0 volts is applied to some of the EC elements 15 (i.e., the voltage of 0V is applied to both the rough ITO layer and the smooth ITO layer), the organic EL element 14 receiving the signal voltage Vsig may emit light and the EC elements 15 receiving the signal voltage Vsig2 may change from the mirror or light-reflective state to the transparent or light-transmissive state, as illustrated on the right of FIG. 20, for example. When the application of voltage to some of the organic EL elements 14 is halted and a predetermined positive voltage, which corresponds to the signal voltage Vsig2, is applied to some of the EC elements 15 (i.e., a positive voltage is applied to the rough ITO layer and a negative voltage is applied to the smooth ITO layer), the organic EL elements 14 emitting light may stop emitting light and turn into the transparent state, and the EC elements 15 in the transparent (i.e., the EC elements 15 having optical transparency) may turn into the mirror state (i.e., may have optical reflectivity), as illustrated on the left of FIG. 20.

As described above, it is possible also in Modification Example B to display an image using the organic EL elements 14 and at the same time perform the enhancement of the image using the EC elements 15, as illustrated in FIGS. 17 to 20. Accordingly, it is possible to achieve novel image-display representation.

Figure 21:
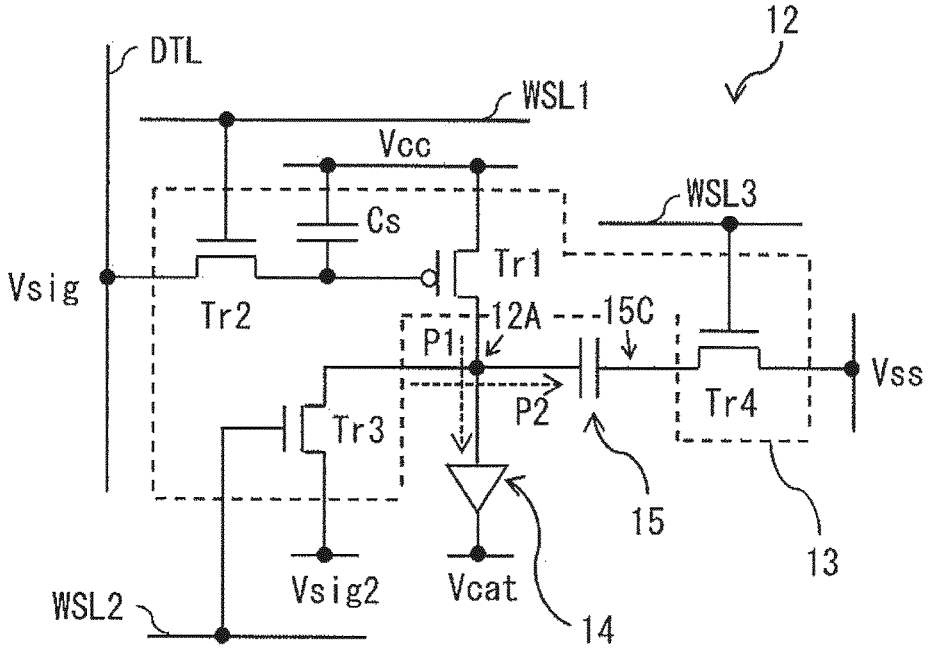
FIG. 21 is an example circuit diagram of a subpixel included in each pixel illustrated in FIG. 16.
Figure 22:
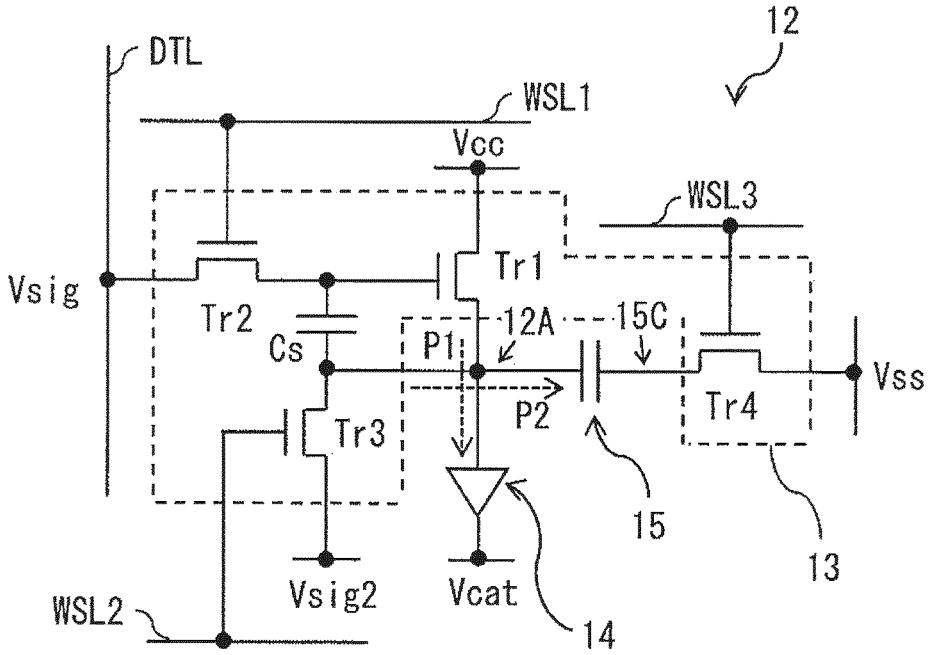
FIG. 22 is an example circuit diagram of a subpixel included in each pixel illustrated in FIG. 16.

In Modification Example B, the constant-voltage wiring line coupled to the switching transistor Tr3 and the constant-voltage wiring line coupled to the switching transistor Tr4 are reversed from those in the foregoing example embodiments and Modification Example A because of the laminated structure of the EC element 15 and the organic EL element 14, as illustrated in FIGS. 21 and 22, for example. Also in Modification Example B of the disclosure, the electric current path P1 may intersect with the electric current path P2, at the node between the EC element 15 and the organic EL element 14. This allows the pixel circuit 13 to selectively drive the organic EL element 14 and the EC element 15. Accordingly, it is possible for the display unit 1 of Modification Example B to provide a similar or the same effects as those of the foregoing example embodiments and modification example.

Modification Example C

Figure 23:
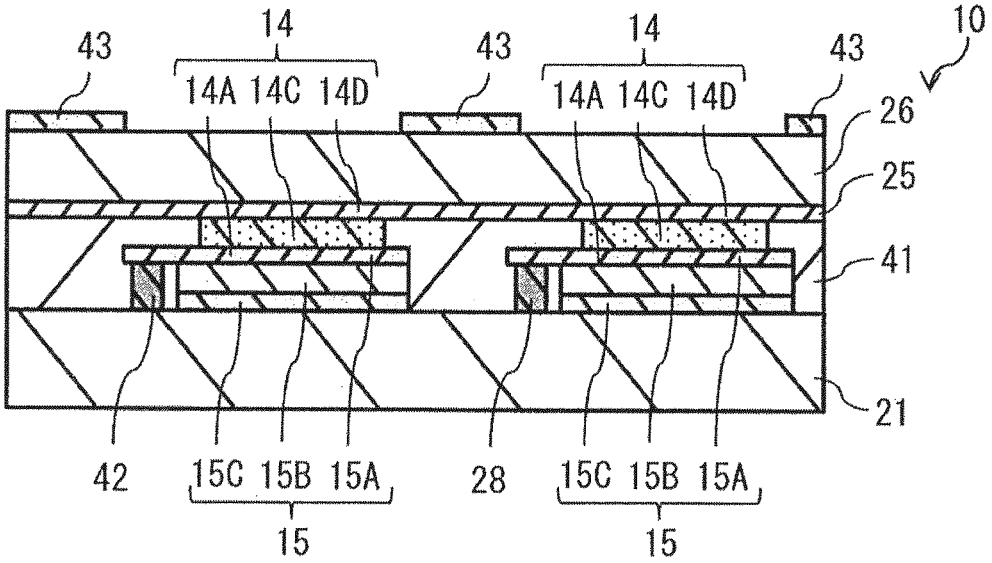
FIG. 23 is a cross-sectional view of the organic EL panel of FIG. 3 according to one modification example of the disclosure.

FIG. 23 illustrates Modification Example C of the cross-sectional configuration of the organic EL panel 10 according to Modification Example B described above. In Modification Example C, the organic EL panel 10 may include a black matrix 43. The black matrix 43 may be provided in a gap between each two adjacent organic EL elements 14, when seen from the normal direction of the organic EL panel 10. The black matrix 43 may be in contact with an upper surface of the sealing layer 26, for example.

Figure 24:
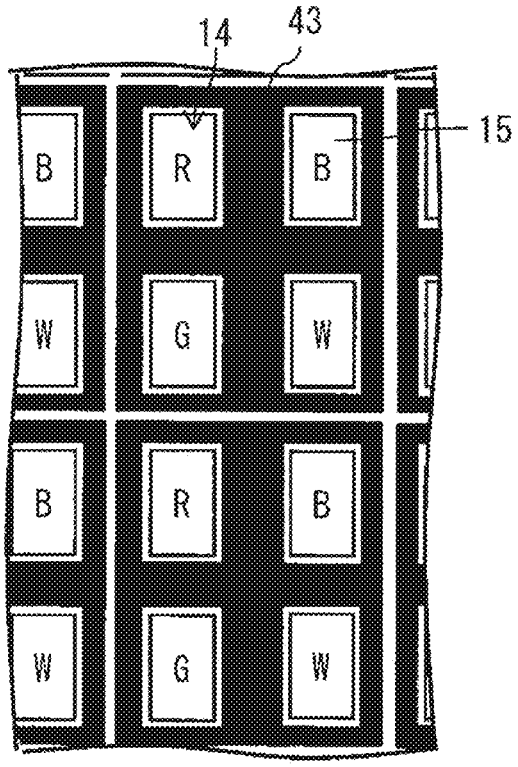
FIG. 24 is an example plan view of the organic EL panel of FIG. 23.

FIG. 24 illustrates an example configuration on an upper surface of the organic EL panel 10 according to Modification Example C. In FIG. 24, both the organic EL elements 14 and the EC elements 15 are in the transparent state. As illustrated in FIG. 24, the gap between each two adjacent organic EL elements 14 may be in the black state because of the presence of the black matrix 43, when seen from the normal direction of the organic EL panel 10. It is possible also in Modification Example C to achieve novel image-display representation, as in the foregoing example embodiments and the modification examples described above.

Modification Example D

Figure 25:
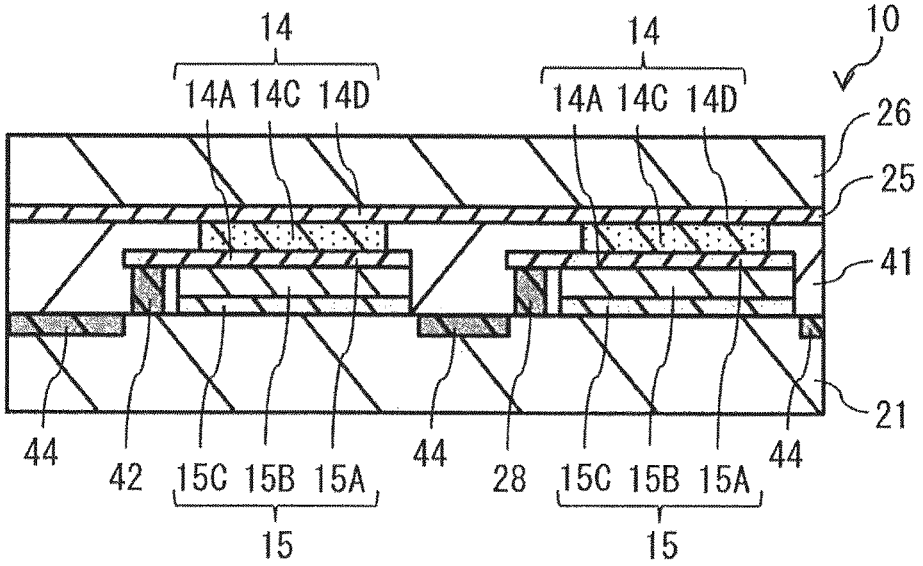
FIG. 25 is a cross-sectional view of the organic EL panel of FIG. 3 according to one modification example of the disclosure.

FIG. 25 illustrates Modification Example D of the cross-sectional configuration of the organic EL panel 10 according to Modification Example B described above. In Modification Example D, the organic EL panel 10 may have a mirror layer 44. The mirror layer 44 may include a metal material having high reflectivity. Specific but non-limiting example of the high-reflective metal material used for the mirror layer 44 may include aluminum (Al), silver (Ag), aluminum alloy, and silver alloy. The mirror layer 44 may be provided in a gap between each two adjacent organic EL elements 14, when seen from the normal direction of the organic EL panel 10. The mirror layer 44 may be provided on the upper surface of the substrate 21, for example.

Figure 26:
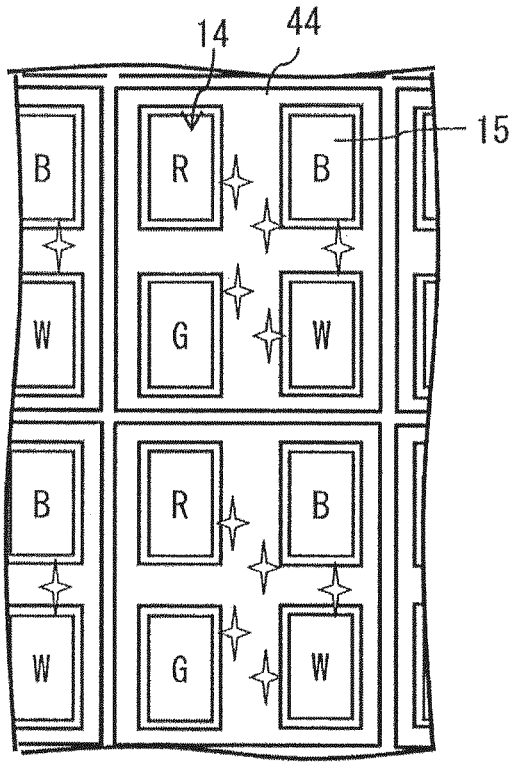
FIG. 26 is an example plan view of the organic EL panel of FIG. 25.
Figure 27:
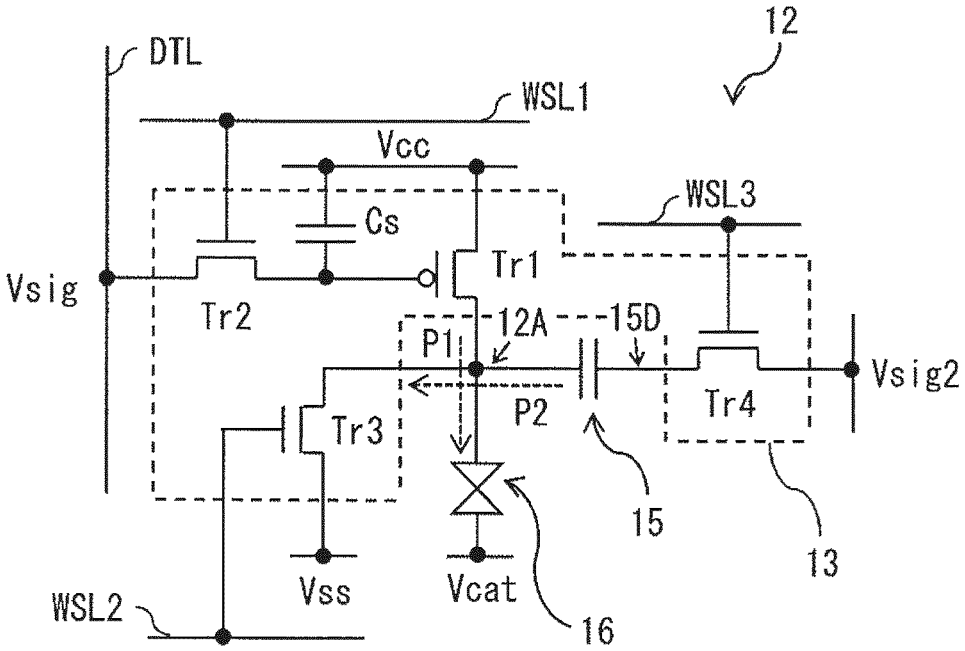
FIG. 27 is an example circuit diagram of a subpixel included in each pixel illustrated in FIG. 3 according to one modification example of the disclosure.
Figure 28:
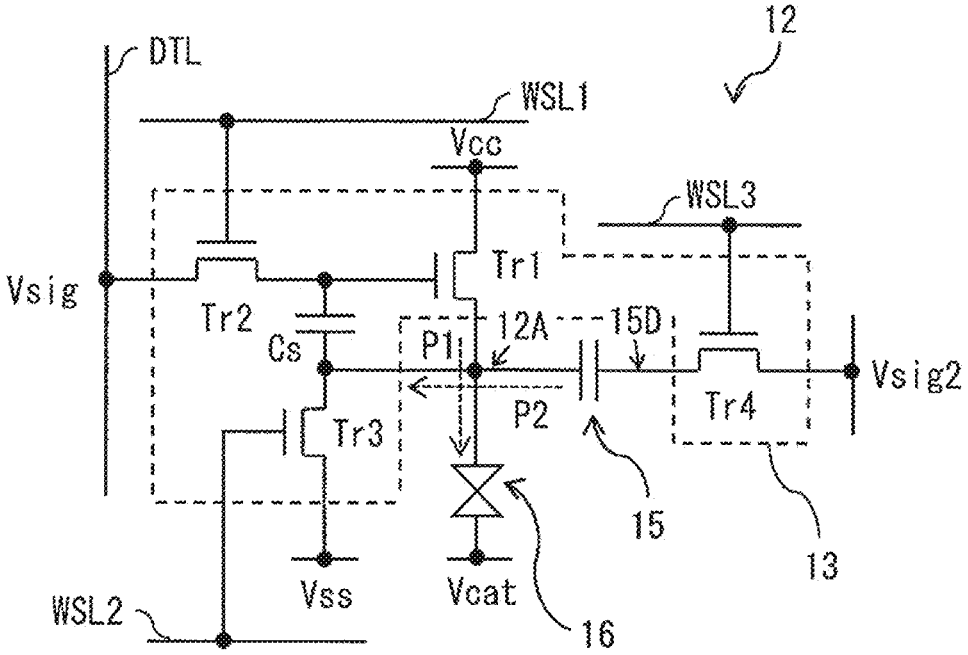
FIG. 28 is an example circuit diagram of a subpixel included in each pixel illustrated in FIG. 14 according to one modification example of the disclosure.
Figure 29:
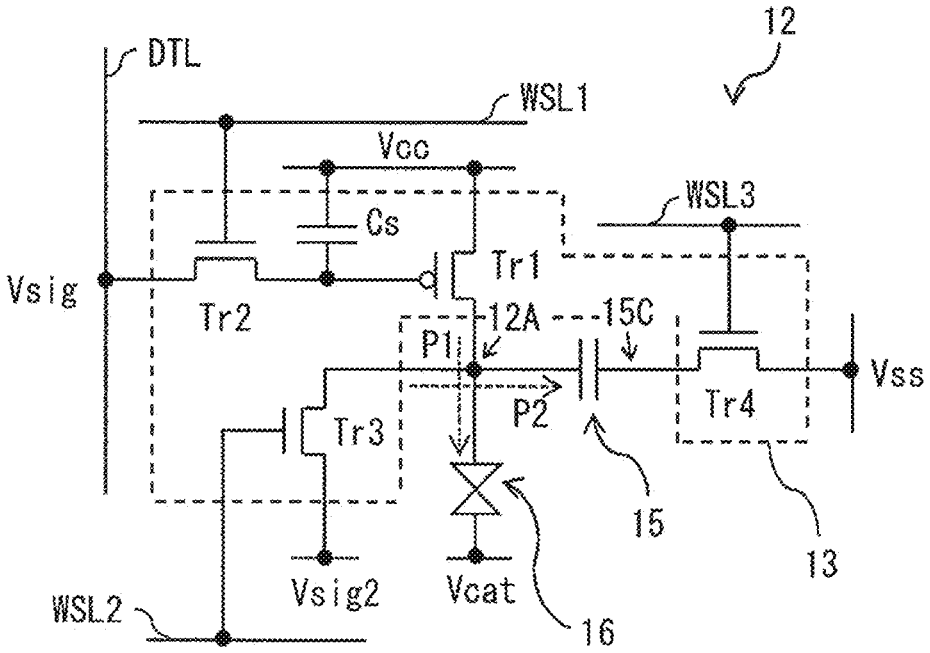
FIG. 29 is an example circuit diagram of a subpixel included in each pixel illustrated in FIG. 27 according to one modification example of the disclosure.
Figure 30:
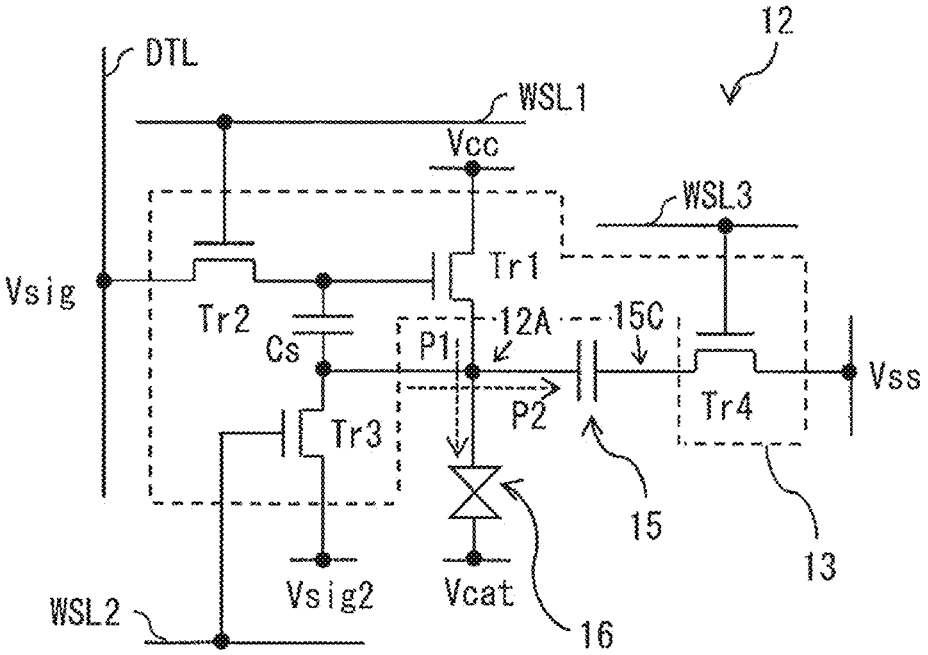
FIG. 30 is an example circuit diagram of a subpixel included in each pixel illustrated in FIG. 28 according to one modification example of the disclosure.

FIG. 26 illustrates an example configuration on the upper surface of the organic panel 10 according to Modification Example D. In FIG. 26, both the organic EL elements 14 and the EC elements 15 are in the transparent state. As illustrated in FIG. 26, the gap between each two adjacent organic EL elements 14 may be in the mirror state (i.e., have optical reflectivity) because of the presence of the mirror layer 44, when seen from the normal direction of the organic EL panel 10. It is possible also in Modification Example D to achieve novel image-display representation, as in the foregoing example embodiments and the modification examples described above.

Modification Example E

Figure 31:
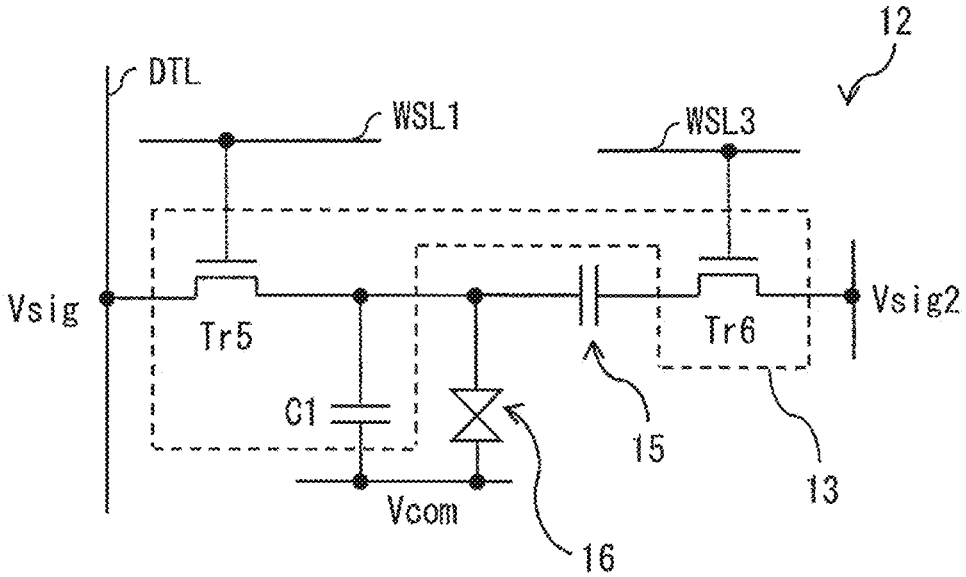
FIG. 31 is an example circuit diagram of a subpixel included in each pixel illustrated in FIGS. 27 to 30 according to one modification example of the disclosure.

According to Modification Example E illustrated in FIGS. 27 to 30, for example, a liquid crystal cell 16 may be provided in place of the organic EL element 14 in the foregoing example embodiments and the modification examples described above. Also in Modification Example E, the electric current path P1 may intersect with the electric current path P2, at the node between the EC element 15 and the liquid crystal cell 16. This allows the pixel circuit 13 to selectively drive the liquid crystal cell 16 and the EC element 15. Accordingly, it is possible for the display unit 1 of Modification Example E to provide a similar or the same effects as those of the foregoing example embodiments and the modification examples. It should be noted that the configuration of the pixel circuit 13 is not limited to the example configurations illustrated in FIGS. 27 to 30, and may be a simple circuit configuration illustrated in FIG. 31, for example. In FIG. 31, the pixel circuit 13 may include switching transistors Tr5 and Tr6, and a storage capacitor C1. A gate of the switching transistor Tr5 may be coupled to the scanning line WSL1. One of source and drain of the switching transistor Tr5 may be coupled to the signal line DTL. The other of the source and drain of the switching transistor Tr5 that is uncoupled to the signal line DTL may be coupled to the EC element 15. A gate of the switching transistor Tr6 may be coupled to the scanning line WSL3. One of source and drain of the switching transistor Tr6 may be coupled to the EC element 15. The other of the source and drain of the switching transistor Tr6 that is uncoupled to the EC element 15 may be coupled to the wiring line of the signal voltage Vsig2. The liquid crystal cell 16 may be coupled to the node between the switching transistor Tr5 and the EC element 15 and a fixed voltage line Vcom. Likewise, the storage capacitor C1 may be coupled to the node between the switching transistor Tr5 and the EC element 15 and to the fixed voltage line Vcom. In other words, the crystal cell 16 and the storage capacitor C1 may be coupled in parallel to each other. The crystal cell 16 may correspond to a specific but non-limiting example of "optical modulator" according to one embodiment of the disclosure.

Modification Example F

Figure 32:
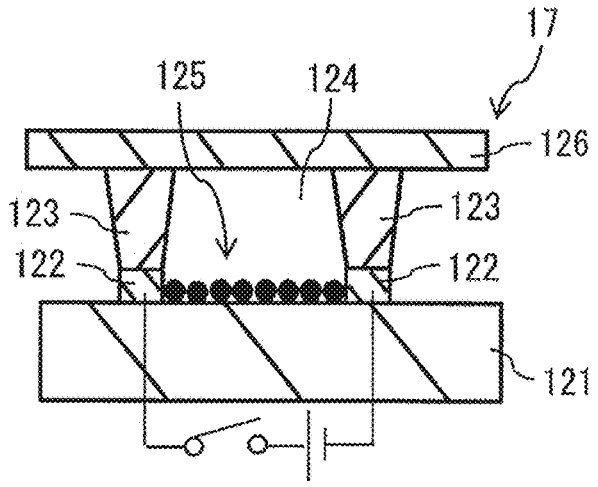
FIG. 32 is an example schematic diagram of an electrophoretic element used in place of an electrochromic element.
Figure 33:
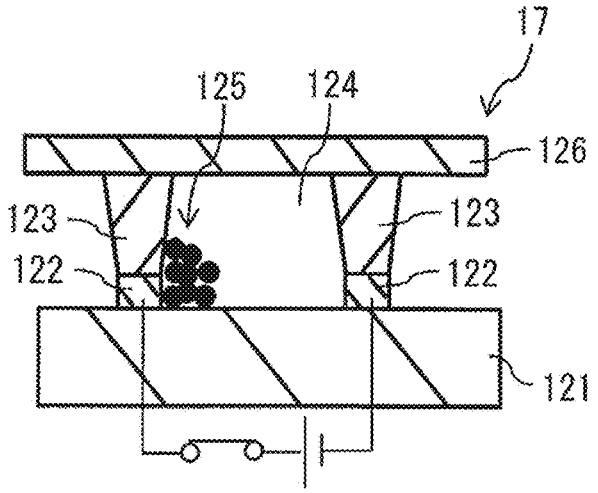
FIG. 33 is a diagram illustrating an example state of the electrophoretic element of FIG. 32 to which a voltage is applied.

According to Modification Example F illustrated in FIGS. 32 and 33, for example, an electrophoretic (EP) element 17 may be provided in place of the EC element 15 in the foregoing example embodiments and the modification examples described above. The EP element 17 may accommodate a liquid 124 in a space defined by a substrate 121, a sealing layer 126, and partition walls 123. The liquid 124 may contain microparticles 125. The microparticles 125 may be aggregated in one place or dispersed in the liquid 124 in response to application of a voltage to paired electrodes 122 provided on the respective partition walls 123, to control light-transmissive and light-blocking properties of the EP element 17. In FIG. 32, the microparticles 125 are dispersed in the liquid 124. In FIG. 33, the microparticles 125 are aggregated in one place.

Also in Modification Example F in which the EP element 17 is provided in place of the EC element 15, it is possible to achieve novel image-display representation, as in the foregoing example embodiments and the modification examples described above.

Modification Example G

Figure 34:
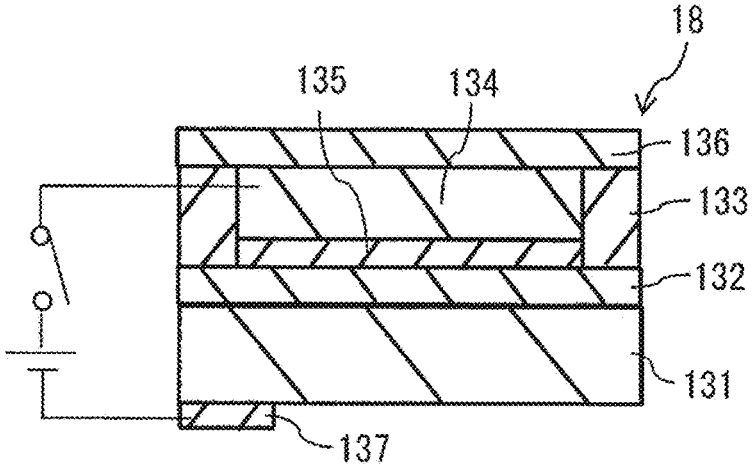
FIG. 34 is an example schematic diagram of an electrowetting element used in place of the electrochromic element.
Figure 35:
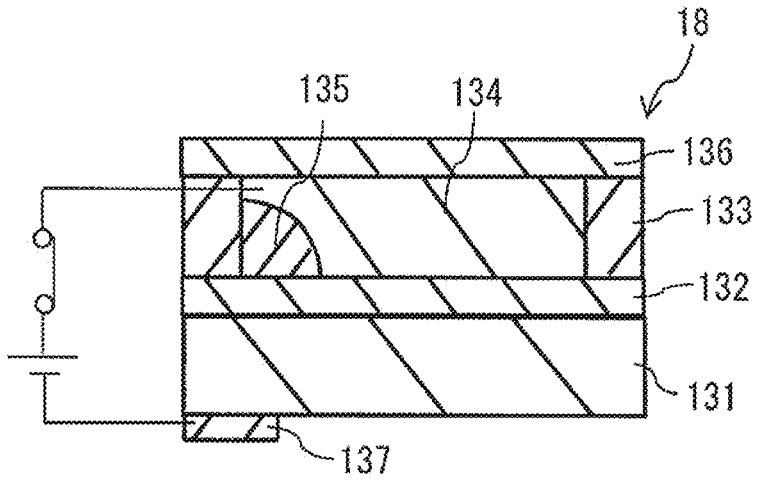
FIG. 35 is an example diagram illustrating an example state of the electrowetting element of FIG. 34 to which a voltage is applied.

According to Modification Example G illustrated in FIG. 34, for example, an electrowetting (EW) element 18 may be provided in place of the EC element 15 in the foregoing example embodiments and the modification examples described above. The EW element 18 may accommodate an electrolyte 134 in a space defined by an insulating layer 132 provided on a substrate 131, a sealing layer 136, and a partition wall 133. The electrolyte 134 may contain a colored oil 135. The oil 135 may be aggregated in one place or dispersed in the space in response to application of a voltage to an electrode provided on the partition wall 133 and an electrode 137 provided at a predetermined position on the substrate 131, to control light-transmissive and light-blocking properties of the EW element 18. In FIG. 34, the oil 135 is dispersed in the electrolyte 134. In FIG. 35, the oil 135 is aggregated in one place.

Also in Modification Example E in which the EW element 18 are provided in place of the EC element 15, it is possible to achieve novel image-display representation, as in the foregoing example embodiments and the modification examples described above.

3. Application Examples

Described below is an application example of the display unit 1 according to any example embodiment or modification example of the disclosure. The display unit 1 according to any example embodiment and modification examples of the disclosure is applicable to a variety of display devices of electronic apparatuses that display images or pictures based on external or internal image signals. Non-limiting examples of the electronic apparatuses may include televisions, digital cameras, notebook personal computers, sheet-like personal computers, portable terminal devices such as mobile phones, and video cameras.

Figure 36:
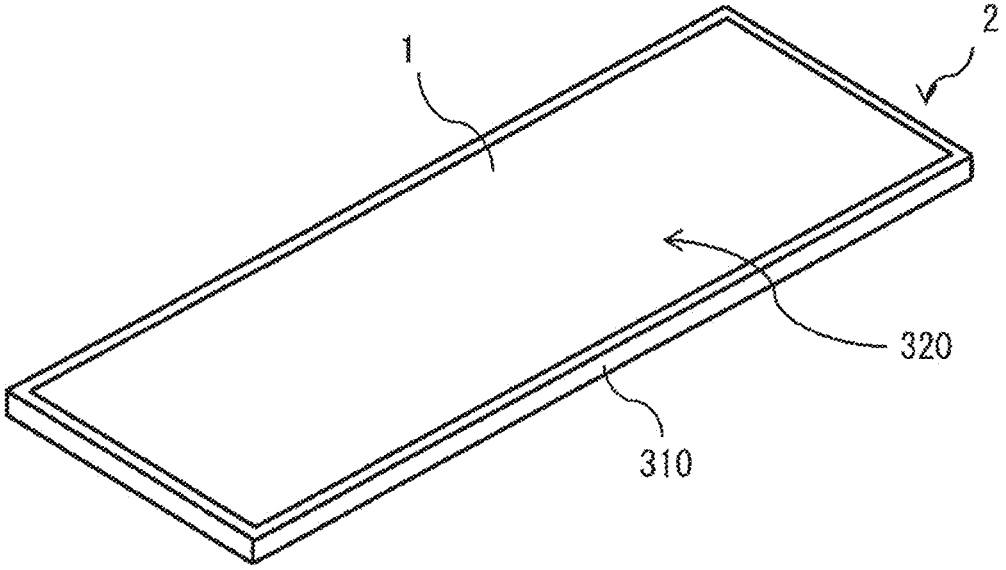
FIG. 36 is an example perspective view of an appearance of an electronic apparatus that includes a display unit according to one embodiment of the disclosure.

FIG. 36 is a perspective view of an electronic apparatus 2 having an example appearance according to an application example. The electronic apparatus 2 may be, for example, a sheet-like personal computer that includes a body 310 having a display surface 320 on a main face. The display unit 1 according to any foregoing example embodiment or modification example of the disclosure may be provided on the display surface 320 of the electronic apparatus 2. The display unit 1 may be so disposed that the organic EL panel 10 is provided on a front surface of the electronic apparatus 2. In this application example, the display unit 1 according to any foregoing example embodiment or modification example of the disclosure may be provided on the display surface 320. This allows the electronic apparatus 2 to achieve high-contrast image displaying.

Although the disclosure is described with reference to the example embodiments, modification examples, and application examples hereinabove, these example embodiments, modification examples, and application examples are not to be construed as limiting the scope of the disclosure and may be modification in a wide variety of ways. It should be appreciated that the effects described herein are mere examples. Effects of an example embodiment of the disclosure are not limited to those described herein. The disclosure may further include any effects other than those described herein. Furthermore, the disclosure encompasses any possible combination of some or all of the various example embodiments and the modification examples described herein and incorporated herein.

It is possible to achieve at least the following configurations from the foregoing example embodiments of the disclosure.

(1) A display unit including a display panel that includes a plurality of pixels arranged in a matrix, each of the pixels including:

one of an optical modulator and a self-luminescent element;

one of an electrochromic element, an electrophoretic element, and an electrowetting element; and a pixel circuit configured to selectively drive the one of the optical modulator and the self-luminescent element, and selectively drive the one of the electrochromic element, the electrophoretic element, and the electrowetting element.

(2) The display unit according to (1), in which the one of the electrochromic element, the electrophoretic element, and the electrowetting element is coupled in parallel to the one of the optical modulator and the self-luminescent element, and the pixel circuit has a first electric current path and a second electric current path that intersect each other at a node between the one of the electrochromic element, the electrophoretic element, and the electrowetting element, and the one of the optical modulator and the self-luminescent element, the first electric current path being a path of an electric current flowing through the one of the optical modulator and the self-luminescent element, the second electric current path being a path of an electric current flowing through the one of the electrochromic element, the electrophoretic element, and the electrowetting element.

(3) The display unit according to (1) or (2), in which the display panel further includes a substrate that supports the plurality of pixels, and the one of the electrochromic element, the electrophoretic element, and the electrowetting element, and the one of the optical modulator and the self-luminescent element are provided on a plane parallel to the substrate.

(4) The display unit according to (1) or (2), in which the one of the electrochromic element, the electrophoretic element, and the electrowetting element, and the one of the optical modulator and the self-luminescent element are laminated to each other.

(5) The display unit according to any one of (1) to (4), in which the one of the electrochromic element, the electrophoretic element, and the electrowetting element is shared between the plurality of pixels.

(6) The display unit according to any one of (1) to (5), in which the one of the electrochromic element, the electrophoretic element, and the electrowetting element has optical transparency while receiving no voltage, and turns into a black or bluish-black state when receiving a voltage.

(7) The display unit according to any one of (1) to (5), in which the electrochromic element is in a white or gray state while receiving no voltage, and turns into a black or bluish-black state when receiving a voltage.

(8) The display unit according to any one of (1) to (5), in which the electrochromic element has optical reflectivity while receiving no voltage, and turns into a black or bluish-black state when receiving a voltage.

(9) The display unit according to any one of (1) to (5), in which the electrochromic element has optical reflectivity while receiving a positive voltage, and has optical transparency while receiving no voltage.

In the display unit according to any example embodiment or modification example of the disclosure, the display element (e.g., optical modulator or self-luminescent element) and the enhancement element (e.g., electrochromic element, electrophoretic element, or electrowetting element) are selectively driven by the pixel circuit. Accordingly, it is possible to display an image using the display elements and at the same time perform the enhancement of the image using the enhancement elements.

In the display unit according to any example embodiment or modification example of the disclosure, the image displaying using the display elements is performed along with the enhancement of the image using the enhancement elements. Accordingly, it is possible to achieve novel image-display representation. Effects of the example embodiments and modification examples of the disclosure are not limited to those described hereinabove, and may be any effect described herein.

Although the disclosure is described hereinabove in terms of example embodiments, it is not limited thereto. It should be appreciated that variations may be made in the described example embodiments by persons skilled in the art without departing from the scope of the disclosure as defined by the following claims. The limitations in the claims are to be interpreted broadly based on the language employed in the claims and not limited to examples described in this specification or during the prosecution of the application, and the examples are to be construed as non-exclusive. For example, in this disclosure, the use of the terms first, second, etc. do not denote any order or importance, but rather the terms first, second, etc. are used to distinguish one element from another. The term "disposed on/provided on/formed on" and its variants as used herein refer to elements disposed directly in contact with each other or indirectly by having intervening structures therebetween. Moreover, no element or component in this disclosure is intended to be dedicated to the public regardless of whether the element or component is explicitly recited in the following claims.

What is claimed is:

1. A display unit comprising a display panel that includes a plurality of pixels arranged in a matrix, each of the pixels including:

an optical modulator or a self-luminescent element; an electrochromic element, an electrophoretic element, or an electrowetting element;

a pixel circuit configured to selectively drive the optical modulator or the self-luminescent element, and selectively drive the electrochromic element, the electrophoretic element, or the electrowetting element;

an indium tin oxide layer contacting a top surface of the electrochromic element, the electrophoretic element or the electrowetting element; and an insulating layer covering the top surface and a sidewall of the electrochromic element, the electrophoretic element or the electro wetting element, wherein the insulating layer is a continuous insulating layer, wherein the indium tin oxide layer contacts a top surface of the optical modulator or the self-luminescent element wherein the electrochromic element, the electrophoretic element or the electrowetting element comprises an electrode, and the electrode is separated from the indium tin oxide layer by the insulating layer.

2. The display unit according to claim 1, wherein the electrochromic element, the electrophoretic element, or the electrowetting element is coupled in parallel to the optical modulator or the self-luminescent element, and the pixel circuit has a first electric current path and a second electric current path that intersect each other at a node between the electrochromic element, the electrophoretic element, or the electrowetting element, and the optical modulator or the self-luminescent element, the first electric current path being a path of an electric current flowing through the optical modulator or the self-luminescent element, the second electric current path being a path of an electric current flowing through the electrochromic element, the electrophoretic element, or the electrowetting element.

3. The display unit according to claim 1, wherein the display panel further includes a substrate that supports the plurality of pixels, and the electrochromic element, the electrophoretic element, or the electrowetting element, and the optical modulator or the self-luminescent element are provided on a plane parallel to the substrate.

4. The display unit according to claim 1, wherein the electrochromic element, the electrophoretic element, or the electrowetting element, and the optical modulator or the self-luminescent element are laminated to each other.

5. The display unit according to claim 1, wherein the electrochromic element, the electrophoretic element, or the electrowetting element is shared between the plurality of pixels.

6. The display unit according to claim 1, wherein the electrochromic element, the electrophoretic element, or the electrowetting element has optical transparency while receiving no voltage, and turns into a black or bluish-black state when receiving a voltage.

7. The display unit according to claim 1, wherein the electrochromic element is in a white or gray state while receiving no voltage, and turns into a black or bluish-black state when receiving a voltage.

8. The display unit according to claim 1, wherein the electrochromic element has optical reflectivity while receiving no voltage, and turns into a black or bluish-black state when receiving a voltage.

9. The display unit according to claim 1, wherein the electrochromic element has optical reflectivity while receiving a positive voltage, and has optical transparency while receiving no voltage.

10. A display unit comprising a display panel that includes a plurality of pixels arranged in a matrix, each of the pixels including:

a self-luminescent element; an electrochromic element, an electrophoretic element or an electrowetting element;

a pixel circuit configured to selectively drive the self-luminescent element, and selectively drive the electrochromic element, the electrophoretic element or the electrowetting element, and a continuous insulating layer covering a top surface and a sidewall of the electrochromic element, the electrophoretic element or the electrowetting element an indium tin oxide layer, wherein the indium tin oxide layer directly contacts the self-luminescent element, and the continuous insulating layer separates the indium tin oxide layer from the top surface of the electrochromic element, the electrophoretic element or the electrowetting element.

11. The display unit according to claim 1, wherein the indium tin oxide layer contacts the top surface of the electrochromic element, wherein the indium tin oxide layer contacts the top surface of the self-luminescent element.

* * * * *